US009738506B2

(12) United States Patent
Groesbeck

(10) Patent No.: US 9,738,506 B2
(45) Date of Patent: Aug. 22, 2017

(54) BAG-IN-BOX ADAPTER FOR WATER DISPENSER

(71) Applicant: Robert Clay Groesbeck, Salt Lake City, UT (US)

(72) Inventor: Robert Clay Groesbeck, Salt Lake City, UT (US)

( * ) Notice: Subject to any disclaimer, the term of this patent is extended or adjusted under 35 U.S.C. 154(b) by 0 days.

(21) Appl. No.: 15/080,416

(22) Filed: Mar. 24, 2016

(65) Prior Publication Data

US 2016/0207751 A1 Jul. 21, 2016

Related U.S. Application Data

(63) Continuation-in-part of application No. 14/490,670, filed on Sep. 19, 2014, which is a continuation-in-part of application No. 13/844,806, filed on Mar. 16, 2013, now Pat. No. 9,227,828.

(51) Int. Cl.
*B67D 3/00* (2006.01)

(52) U.S. Cl.
CPC ..... *B67D 3/0032* (2013.01); *B67D 3/0009* (2013.01); *B67D 3/0067* (2013.01); *B67D 3/0083* (2013.01); *B67D 2210/00062* (2013.01)

(58) Field of Classification Search
CPC .... B67D 3/008; B67D 3/0035; B67D 3/0038; B67D 3/0067; B67D 3/0093
USPC ..... 141/351, 363–366; 222/146.6, 160, 222/185.1
See application file for complete search history.

(56) References Cited

U.S. PATENT DOCUMENTS 3,060,703 A * 10/1962 Benua ..... F25D 31/002 222/105
3,688,950 A * 9/1972 Laurence ..... B67D 3/00 222/146.1
3,843,021 A * 10/1974 Schieser ..... B65D 77/06 222/105
6,098,844 A * 8/2000 Nicolle ..... B67B 7/28 222/105
6,398,073 B1 * 6/2002 Nicolle ..... B67B 7/28 222/105
6,442,960 B1 * 9/2002 Fournier ..... B67D 1/07 222/146.6
6,557,735 B1 * 5/2003 Stray ..... B67D 3/0029 222/185.1

(Continued)

*Primary Examiner* — Timothy L Maust
(74) *Attorney, Agent, or Firm* — Thorpe North & Western LLP

(57) ABSTRACT

An adapter to convert a conventional water cooler designed for use with substantially rigid water bottles as the source of water to use of bag-in-box liquid containers as the source of water includes a holder for removably holding a bag-in-box liquid container in place of the water bottle at the top of the water cooler and a liquid supply line connectable to a bag dispensing fitting of a bag-in-box liquid container positioned in the holder and a water bottle opening cap engaging pin above a water reservoir in the water cooler. Water from the bag-in-box liquid container can flow by gravity from the bag-in-box liquid container through the liquid supply line and the water bottle opening cap engaging pin into the reservoir. A water level controller to control the flow of water from the bag-in-box container into the water reservoir to control the level of water in the reservoir can also be included.

16 Claims, 25 Drawing Sheets

(56) References Cited

U.S. PATENT DOCUMENTS

| | | | | |
|---|---|---|---|---|
| 7,331,487 | B2 * | 2/2008 | Macler, II | B67B 7/28<br>222/105 |
| 7,975,879 | B2 * | 7/2011 | Groesbeck | B65D 5/4204<br>220/4.01 |
| 8,875,944 | B2 * | 11/2014 | Shiotani | B67D 3/0009<br>141/352 |
| 9,227,828 | B2 * | 1/2016 | Groesbeck | B67D 3/0067 |

* cited by examiner

BAG-IN-BOX ADAPTER FOR WATER DISPENSER

RELATED APPLICATIONS

This is a continuation-in-part of application Ser. No. 14/490,670, filed Sep. 19, 2014, which was a continuation-in-part of application Ser. No. 13/844,806, filed Mar. 16, 2013, now U.S. Pat. No. 9,227,828, issued Jan. 5, 2016, both of which are incorporated herein in their entirety by reference.

BACKGROUND

Field of the Invention

The present invention relates generally to water dispensers commonly referred to as water coolers. More particularly, the present invention relates to water dispensers or water coolers wherein a container of water comprising a substantially rigid water bottle is placed on the top of the water dispenser and water is fed by gravity from the water container above the dispenser into a water reservoir in the dispenser wherein the water is cooled or heated by the dispenser and the cooled or heated water can then be dispensed by a user from the dispenser. The present invention also relates to bag-in-box liquid containers and dispensers for the liquid in such bag-in-box dispensers.

Related Art

Water dispensers, commonly also referred to as water coolers, are currently in common use throughout the world. With such water dispensers, water is supplied to the water dispenser from a substantially rigid, usually five gallon, water bottle made of glass or plastic and having a narrow neck forming the bottle opening. The bottle is inverted (neck and bottle opening facing downwardly) and placed on the top of the dispenser so that water flows by gravity from the bottle opening into a water reservoir in the dispenser where the water is cooled, and in newer water dispensers, a portion of the water is also heated. The cooled or heated water is then dispensed from the dispenser when desired by a user into a cup, glass, or other container for use by the user, usually for drinking. When the water bottle is inverted and placed on top of the water dispenser, the end of the water bottle neck with the bottle opening extends into the water reservoir. The flow of water from the water bottle is generally controlled by controlling flow of air into the bottle so that water flow is stopped by a vacuum created in the inside top of the water bottle as water flows from the bottle and air is prevented from entering the bottle. Air flow into the bottle is generally stopped by water in the reservoir reaching and closing the bottle opening in the reservoir when the reservoir is filled to the desired level set by the position of the opening into the bottle with respect to the reservoir. Cooled and/or heated water is dispensed from the water cooler by one or more user operated discharge valves which, when opened, allow water to flow from the cooled and/or heated water reservoir or reservoirs through the discharge valve or valves. As water is dispensed from the dispenser, the water level in the cooled and/or heated water reservoir goes down below the opening to the bottle and air can enter the bottle to allow additional water to flow from the bottle down into the reservoir until the water in the reservoir again covers the bottle opening to prevent further air flow into the bottle and further water flow from the bottle. This water flow control is based upon the substantial rigidity of the water bottle, i.e., the water bottle holds its shape and does not collapse so that unless air enters the bottle, a vacuum is maintained above the water in the bottle sufficient to prevent water from running out of the bottle. These substantially rigid water bottles are relatively expensive and are generally reusable. Full water bottles are delivered to the site of the water dispenser and empty water bottles are picked up, refilled, and reused.

Many of the currently used water bottles include a water bottle opening cap covering the water bottle opening which interacts with a water bottle opening cap engagement pin extending upwardly from the water cooler water reservoir so that when the water bottle is inverted and placed on the top of the water cooler, the water bottle opening cap engagement pin extends through the water bottle opening cap into the water bottle to provide a water flow path from the bottle into the reservoir. The water bottle opening cap engagement pin is secured in the water cooler reservoir and the opening of the water bottle opening cap engagement pin into the water reservoir serves as the opening of the bottle into the reservoir which the water in the reservoir closes to stop flow of water into the reservoir from the bottle to control the water level in the reservoir.

Bag-in-box container systems have become widely used as packing and shipping containers for a variety of liquid products such as soft drink syrup, milk, and wine. Such systems include a flexible bag or bladder disposed in a cardboard box such as a corrugated cardboard box. The flexible bag can conform to the shape of the inside of the box when filled with a liquid material. The box provides a fixed container shape for the bag and contents and protects the bag and contents during storage and shipping, and, in many instances, provides a holder for the bag during the dispensing of the contents of the bag. The bag will generally include a bag dispensing fitting secured thereto which is used to dispense the contents of the bag from the bag. The bag dispensing fitting can be located at various locations on the bag depending upon the application, such as at the bottom of the bag when positioned in the box when the contents of the bag is to be removed by gravity while the bag remains in the box. In such instance, the box will generally include an area adjacent the bag dispensing fitting which opens to expose the bag dispensing fitting and allow controlled gravity discharge of the contents of the bag. However, the bag does not provide a rigid container for the liquid and the bag collapses within the box when liquid is removed from the bag. Air does not flow into the bag. Such bag-in-box containers are usually relatively inexpensive to make and easy to produce and assemble. Therefore, the bag-in-box container is usually disposable and is disposed of after use rather than being saved and refilled. Bag-in-box containers come in various sizes, with many such containers having a five gallon capacity similar to the five gallon substantially rigid water cooler bottles.

Recently, water has become one of the liquids packaged in bag-in-box containers and water can be dispensed directly from the bottom portion of the bag-in-box container similarly to the way wine and milk is dispensed from such containers. Dispensers are being developed for cooling and heating water from bag-in-box containers of water and for dispensing such cooled and/or heated water, see, for example, U.S. Pat. No. 7,975,879. However, because the bags containing the water are not rigid and collapse as the water is dispensed from the bag, such bag-in-box containers with a flexible bag cannot be directly used with the various water dispensers designed for use with five gallon substantially rigid water bottles.

Adapters for adapting a conventional water cooler for use with a flexible bag full of water rather than a substantially rigid water bottle are shown in U.S. Pat. Nos. 6,398,073, 7,331,487, and 8,117,096. These adapters show holders for receiving and holding a flexible bag of water above a water cooler and such holders include a piercing spike in the bottom thereof to pierce the bag as it is dropped into the holder to allow flow of water from the bag through the spike into the water reservoir of the cooler. Such flexible bags are not shown with bag dispensing fittings and no bag dispensing fitting is used in the adapters shown. U.S. Pat. No. 6,398,073 shows a ballcock float valve in the fluid passage from the spike to the reservoir to control the flow of water from the bag into the reservoir and to stop water flow when the level of water in the reservoir reaches a desired level as indicated by the float of the ballcock valve. U.S. Pat. No. 7,331,487 shows a sealed water reservoir with an open vent tube extending upwardly from the reservoir alongside the bag. The vent tube opens to the atmosphere above the top of the bag so that water fills the sealed reservoir and extends up into the vent tube. The water level in the vent tube is equalized with the water level in the bag. U.S. Pat. No. 8,117,096 shows a completely sealed water reservoir formed in the dispenser so that water flows from the bag into the reservoir and out through the dispenser valve. An air vent between the reservoir and the inside of the bag is provided so that air can flow between the sealed reservoir and the inside of the bag to allow water to flow into and substantially fill the sealed reservoir when the bag is initially connected to the reservoir. In this manner, the water cooler reservoir is substantially filled with water so that the water is cooled or heated in the reservoir prior to being dispensed from the dispenser.

The above described bag dispensers all provide bag receiving holders mounted on the top of the water cooler with spikes in the bottom thereof upon which the full water bags are dropped so that the spikes puncture the bottom of the water bag to extend into the water bag to provide fluid communication between the inside of the bag and the fluid reservoir thereby allowing fluid flow from the bag into the reservoir. The spikes are designed so that the bag being punctured seals around the spike to prevent leakage around the spike. While the water filled bags as used in the above described bag dispensers can be packaged and shipped in boxes, if packaged and shipped in boxes, the bags have to be removed from the boxes before used in the water coolers and the large, heavy, and bulky flexible bags full of water have to be removed from the box, lifted above the bag receiving holder mounted on top of the water cooler, and lowered or dropped into the bag receiving holder so that the spikes penetrate the bottom of the bag to allow water to flow into the water cooler reservoir. After use, the empty or almost empty bags have to be retrieved from the bag receiving holder, and if not completely empty, the remaining water from the bag will run into the bag receiving holder when the bag is removed from the spikes and may continuing running as the bag is moved from the holder to its disposal container. It should be noted that these spikes are not the same as or equivalent to the water bottle opening cap engagement pins which extends through a water bottle opening cap to provide a water flow path from a substantially rigid water bottle into the reservoir.

SUMMARY OF THE INVENTION

Applicant has recognized that it would be advantageous to be able to use bag-in-box water containers as replacements for the standard substantially rigid five gallon water bottles currently used in the common water coolers designed for use with such five gallon substantially rigid water bottles. Alternately, it would be advantageous to provide a water or other liquid dispenser similar to the common water coolers but which use bag-in-box liquid containers as the liquid source. The bag-in-box containers, being disposable, are more economical than the five gallon substantially rigid water bottles. The bag-in-box containers can be easily delivered to the site of such water coolers similarly to the delivery of the water bottles. However, since the bag-in-box containers are disposable, they do not need to be collected and returned for sterilization, refilling, and reuse. The boxes of the bag-in-box containers generally have openings in the sides thereof which serve as handles for picking up and lifting the bag-in-box containers which make it easier to lift the bag-in-box containers to place them on top of the standard water coolers. In addition, since the box of the bag-in-box container holds the flexible bag, a separate bag receiving holder is not required on the top of the water cooler so the bag-in-box container does not have to be lifted as high as the bag does to be placed in a bag receiving holder mounted on top of the water cooler. Further, a bag dispensing fitting secured to the bag in the bag-in-box container can include a valve so that the bag dispensing fitting can be attached to a hose leading into the water cooler reservoir and the valve can be opened after the attachment, and can be closed before disconnection of the fitting and removal of the bag-in-box container from the water cooler for disposal. This prevents leakage of water during removal of the bag. Therefore, the bag-in-box containers are easier to use than the five gallon water bottles which need to be lifted and inverted for insertion into the cooler and are easier to use than a flexible water bag that needs to be lifted above the bag holders and dropped into the holders and then removed from the holders without being closed. The bag-in-box containers are also more economical than the five gallon substantially rigid bottles.

According to the invention, an adapter is provided to receive and hold a bag-in-box container on top of the water cooler and to direct the flow of water or other liquid from the bag-in-box container into the water cooler. When water is referred to herein, it includes any liquid that may be supplied in a bag-in-box liquid container that needs to be dispensed from the container. The adapter includes a liquid supply line having a bag dispensing fitting connector adapted to be removably connected to the bag dispensing fitting of the bag in the bag-in-box container to allow liquid to flow from the bag through the liquid supply line and into the water cooler. A reservoir fitting may be provided to position an outlet end of the liquid supply line over the reservoir. The water is then cooled and/or heated in the water cooler by water temperature control mechanisms and the cooled and/or heated water can be dispensed from the water cooler by a user, when desired, through the appropriate cool water or hot water discharge valve.

In one embodiment of the adapter of the invention, the liquid supply line supplies liquid from the bag in the bag-in-box container to the water reservoir of the water cooler. The adapter also provides control for the flow of water from the bag into the reservoir and for maintaining a desired level of water in the reservoir. Water flow into and level control of water in the reservoir may be provided by controlling the flow of water into the reservoir from the water supply line, by sealing the reservoir from the atmosphere and controlling the venting of the sealed reservoir to the atmosphere, or by a combination of both. An example of control of the flow of water into the reservoir from the water supply line is a special float valve that allows high flow capacity at low pressures, and examples of control of the venting of a sealed reservoir to the atmosphere can be through the use of hydrophobic membrane materials at the entrance to a reservoir vent positioned at the desired level of water in the reservoir which will allow air to flow through the membrane but not allow water to flow through the membrane, or through the use of float valves in the vent.

While the adapter of the invention may include a reservoir fitting to receive and position the outlet end of the liquid supply line over the reservoir wherein the reservoir fitting is an additional assembly inserted into the top of the water cooler reservoir of the existing water cooler, is a replacement assembly which replaces an assembly in the top of the reservoir or over the top of the reservoir of the existing water cooler, or is a modification of an existing assembly in the top of the water cooler reservoir wherein the outlet end of the liquid supply line is received in the assembly in place of the normal water bottle opening cap engaging pin, the reservoir fitting may be an existing assembly in the top of the water cooler reservoir which includes a water bottle opening cap engaging pin adapted to extend through the water bottle opening cap of a substantially rigid water bottle for which the water cooler was designed to be used with. In such instance, the outlet end of the liquid supply line is adapted to connect to the water bottle opening cap engaging pin so that water will flow from the liquid supply line into the water bottle opening cap engaging pin and through the water bottle opening cap engaging pin into the reservoir. Any of these alternatives provide a cover for the reservoir which receives the outlet or discharge end of the liquid supply line and directs the liquid from the liquid supply line into the reservoir.

In another embodiment of the adapter, the usual reservoir of the water cooler is replaced with a reservoir in the form of a heat exchanger having a liquid flow passage therethrough through which the liquid to be dispensed flows from the bag-in-box liquid container to the discharge valve or valves. The liquid supply line from the bag-in-box liquid container connects to an inlet of the heat exchanger to supply water from the bag in the bag-in-box liquid container to the inlet of the heat exchanger. The outlet of the heat exchanger is connected in flow communication with the appropriate discharge valve so that water flow from the bag and through the heat exchanger is controlled by the appropriate discharge valve. The heat exchanger cools and/or heats the water as the water flows through the liquid flow passage through the heat exchanger when the appropriate discharge valve is opened. The heat exchanger may include a spiral passage through a cooled or heated mass of material having high heat capacity and/or high heat transfer properties, such as a metal or gel block.

Rather than providing the invention as an adapter for an existing water cooler, the invention can be provided as a new liquid dispenser having the properties and construction as an adapted existing water dispenser would have.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENTS

Figure 1A:
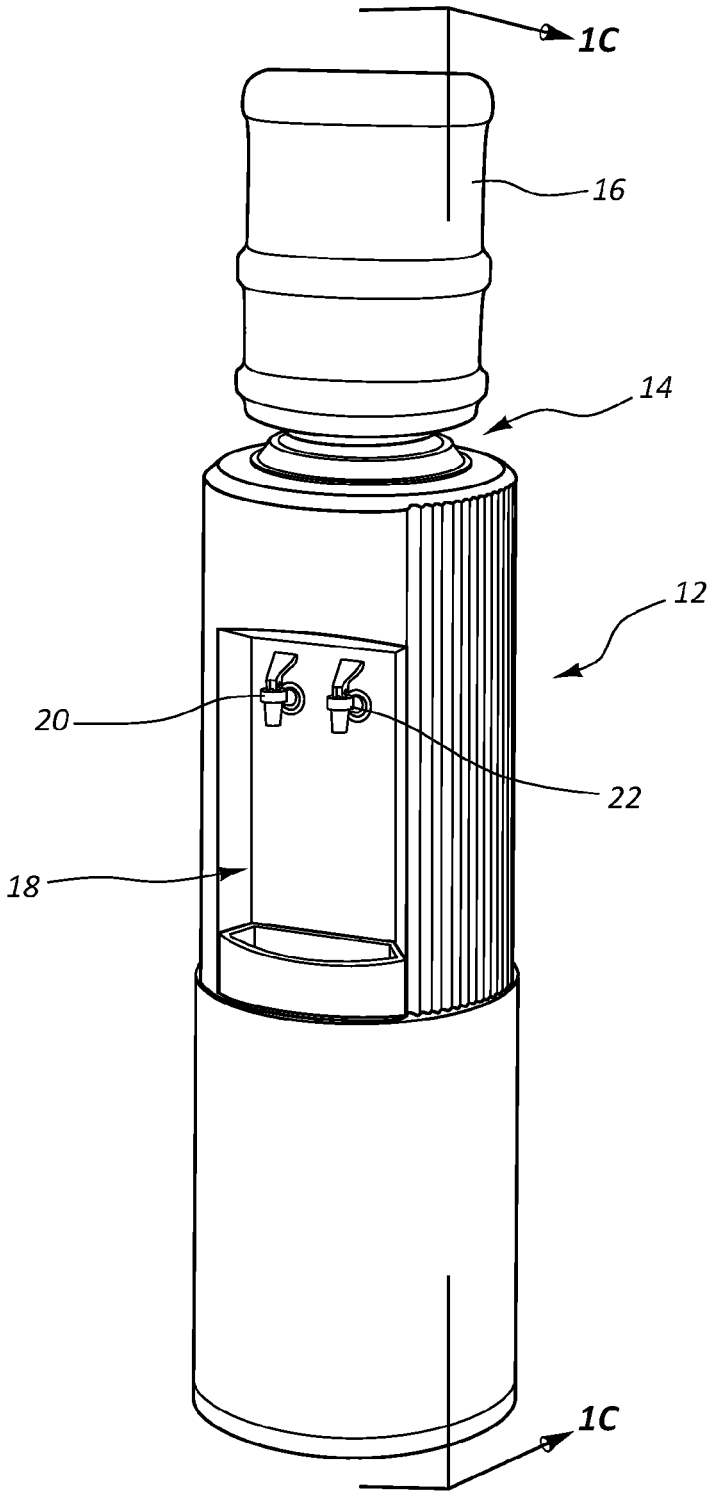
FIG. 1A (Prior Art)
FIG. 1A is a pictorial view of a prior art water cooler with which the adapter of the invention can be used.
Figure 1B:
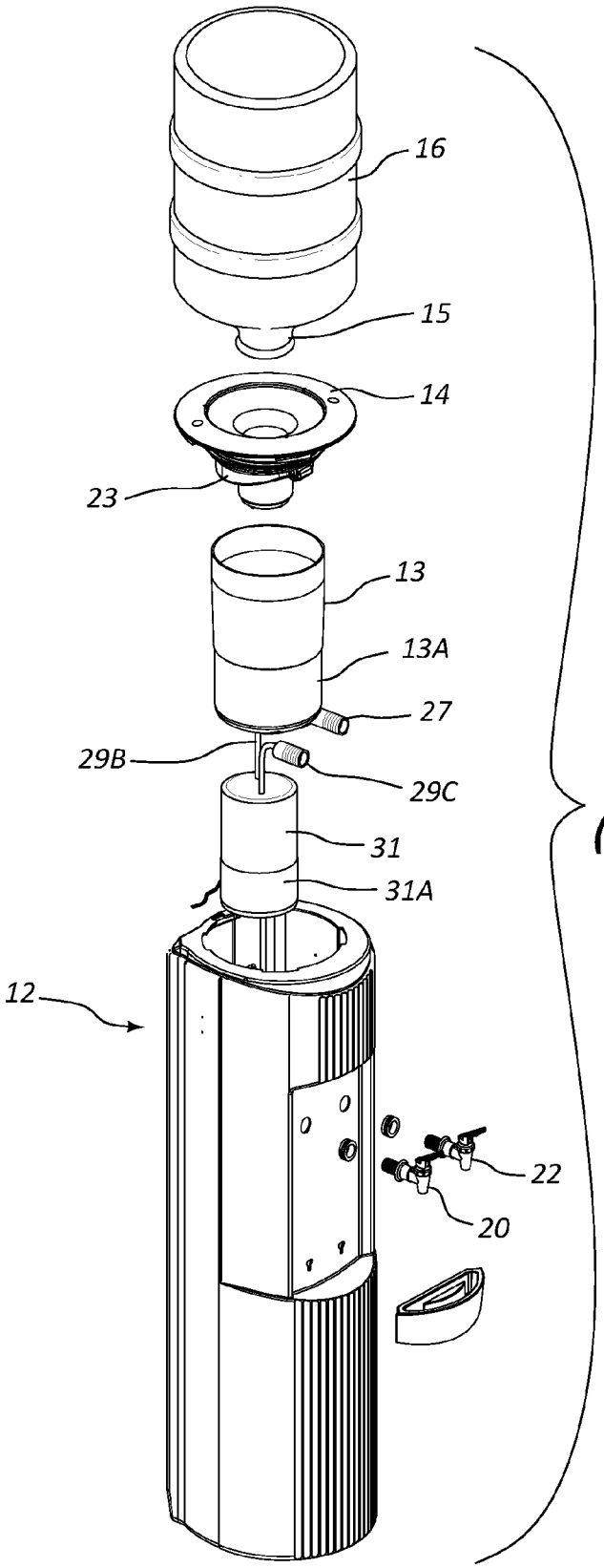
FIG. 1B (Prior Art)
FIG. 1B is an assembly view of the prior art water cooler of FIG. 1A showing the parts thereof through which water from the rigid water bottle flow between the water bottle and the discharge valves of the water cooler of FIG. 1A.
Figure 1C:
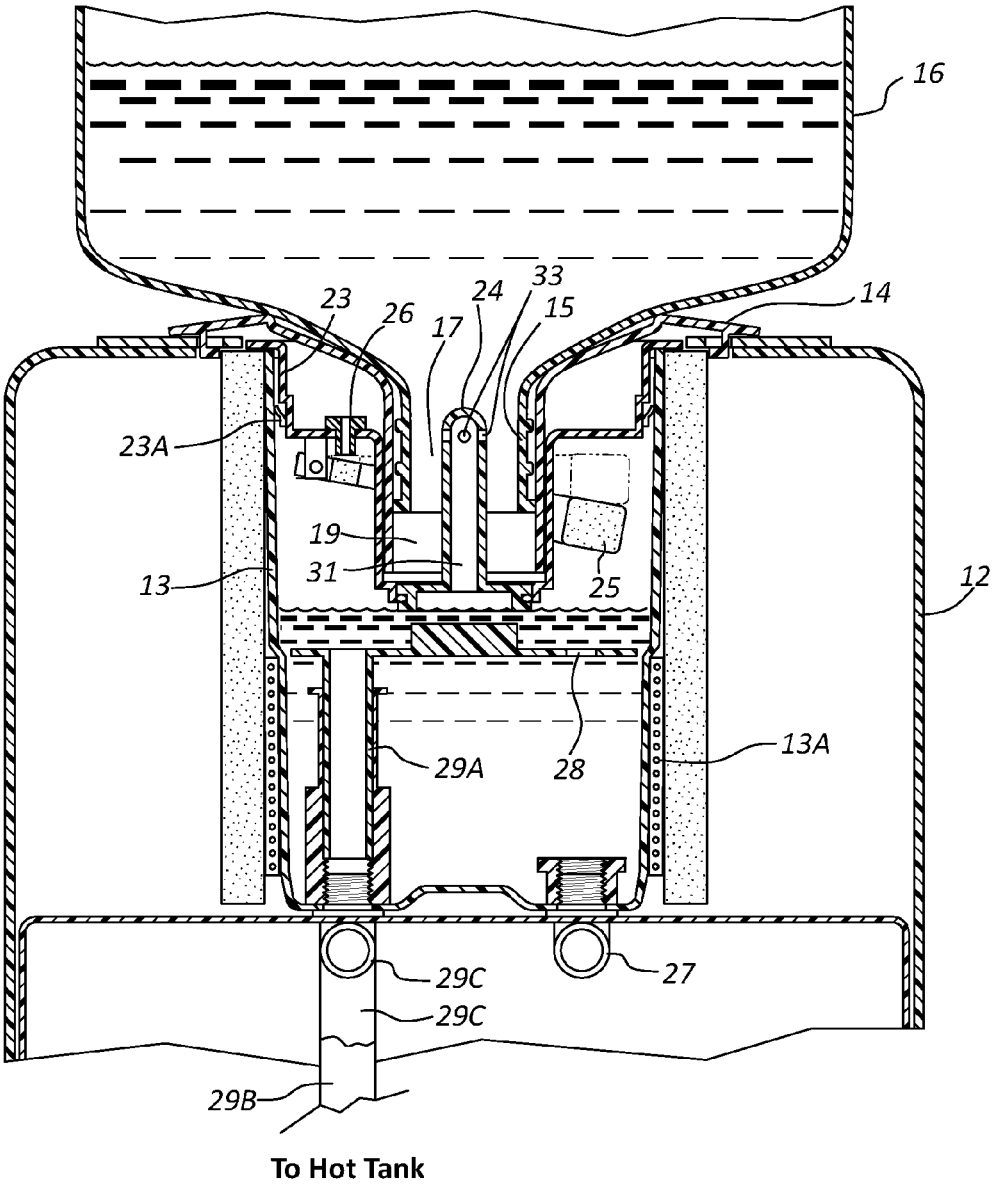
FIG. 1C (Prior Art)
FIG. 1C is a fragmentary vertical section through the upper portion of the prior art water cooler of FIG. 1A showing the arrangement of the parts thereof shown in FIG. 1B.

The invention is a liquid dispenser for dispensing liquid from a liquid containing bag in a bag-in-box liquid container, and is based on adapting standard prior art water coolers that use substantially rigid five gallon water bottles as the water supply to allow the water cooler to use a bag-in-box water container rather than the rigid five gallon water bottle. The adapters of the invention replace selected parts of the standard prior art water coolers to adapted the water coolers to use of the bag-in-box liquid containers. An adapter of the invention can be configured for use with various models and brands of prior art water coolers with minor modifications that will be obvious to those skilled in the art and without departing from the inventive aspects described herein. For purposes of this detailed description, an example of the invention will be illustrated and described for use with Glacier Series Bottled Water Coolers manufactured by Crystal Mountain Products Ltd. having an office in Edmonton, Alberta, Canada. Such bottled water coolers are readily available in the United States and are similar to most bottled water coolers commercially available in the United States and in most other parts of the world. FIGS. 1A-1C show a Glacier Series Bottled Water Cooler as available from Crystal Mountain Products Ltd. As shown, the water cooler includes a water cooler body 12 which rests on a supporting surface, such as a floor, and includes cooled water reservoir 13 with a water bottle support assembly 14 forming the top of water cooler body 12 and which is positioned over and extends into the open top of cooled water reservoir 13, FIGS. 1B and 1C, when assembled inside the top portion of the water cooler body 12. Water bottle support assembly 14 receives and supports a five gallon substantially rigid water bottle 16 in inverted position (water bottle neck 15 and water bottle opening 17 facing downwardly) on the top of water cooler body 12. Water bottle 16 will normally have a cap 19, FIG. 1C, over the opening 17. FIG. 1C shows the details of one embodiment of the water bottle support assembly of the prior art Galcier Series Water Cooler, referred to as the DryGuard™ Assembly, which are shown and described in more detail in prior art U.S. Pat. No. 7,051,902, incorporated herein in its entirety by reference. FIG. 1B shows the water bottle 16 in inverted position above the water bottle support assembly 14 and cooled water reservoir 13 ready to be lowered into its supported position shown in FIGS. 1A and 1C hereof. Water cooler body 12 also includes a recessed portion 18 with heated water discharge valve 20 and cooled water discharge valve 22 accessible to a user to allow a user to fill a container, such as a cup, with either cooled water or heated water from the cooler.

In the prior art embodiment shown in FIGS. 1B and 1C and in prior art U.S. Pat. No. 7,051,902, a water bottle adapter 23 is provided below water bottle support assembly 14 with a circumferential lip seal 23A that bears against the interior surface of the cooled water reservoir 13 to, with water bottle adapter 23 and water bottle support assembly 14, seal the cooled water reservoir from the atmosphere to form a sealed cooled water reservoir. Water bottle adapter 23 includes a bottle cap engaging pin 24, FIG. 1C, extending upwardly from the bottom thereof to engage and extend through bottle cap 19. Bottle cap engaging pin 24 has a passage 31 therethrough opening at is bottom end into reservoir 13 and communicating through openings 33 near the top end of bottle cap engaging pin 24 with the interior of bottle 16 to allow water to flow from bottle 16, through openings 33 and passage 31 into reservoir 13 and allow air from reservoir 13 to flow in reverse direction into bottle 16. Thus, when bottle 16 is positioned on top of water cooler body 12 as shown in FIGS. 1A and 1C, fluid communication is established through bottle cap engaging pin 24 between the interior of bottle 16 and the interior of reservoir 13. During normal operation of the illustrated prior art water cooler, reservoir 13 is open to the atmosphere through vent 26. The water cooler operates in normal manner with water flowing from bottle 16 into reservoir 13 and air bubbling into bottle 16 from reservoir 13 until reservoir 13 is filled with water to a level to cover the entrance provided by bottle cap engaging pin 24 into bottle 16 (i.e., the open bottom end of passage 31) to block further flow of air into bottle 16. Flow of water then ceases from bottle 16 into reservoir 13 until the water level in reservoir 13 drops to uncover the entrance provided by bottle cap engaging pin 24 into bottle 16 to allow flow of air into bottle 16 and flow of water into reservoir 13. The particular embodiment of prior art shown in FIG. 1C provides a safety feature to prevent over flow of water from the cooler in the event of a hole in bottle 16 which allows air to flow into bottle 16 and water to flow from bottle 16 regardless of whether air can flow into bottle 16 from reservoir 13. In such case, the water level in reservoir 13 will rise and cause float 25 to close vent 26 and stop further flow of water into the then sealed reservoir 13. This closure is designed for and provided to operate only in emergency situations to prevent overflow of water if the substantially rigid water bottle 16 develops a hole therein. It is not used for normal control of water flow from the substantially rigid water bottle 16. Normal control of water flow from the substantially rigid water bottle 16 into reservoir 13 is provided by the water level in reservoir 13 rising to the bottom opening of passage 31 through bottle cap engaging pin 24 to thereby block the flow of air from reservoir 13 into passage 31 and into substantially rigid water bottle 16.

During normal operation of the water cooler shown in FIGS. 1A-1C, water flows from bottle 16 into cooled water reservoir 13. Cooled water reservoir 13 is provided with a cooling element 13A surrounding the lower part of cooled water reservoir 13. Cooled water outlet tube 27 extends from the bottom of cooled water reservoir 13 to cooled water discharge valve 22. Water at the top of cooled water reservoir 13 is directed by baffle disc 28 into water discharge pipe 29A and into water discharge tube 29B extending from the bottom of cooled water reservoir 13. Water discharge tube 29B connects to a heated water reservoir 31 where water is heated and stored as heated water. A heating element 31A is wrapped around the lower part of heated water reservoir 31 to heat the reservoir and water therein. A heated water tube 29C connects the heated water reservoir to the heated water discharge valve 20. A separate heating reservoir is provided in all prior art water dispensers that provide heated water. If room temperature water is provided rather than heated water, water discharge tube 29B would be connected to a room temperature water discharge valve.

Figure 2:
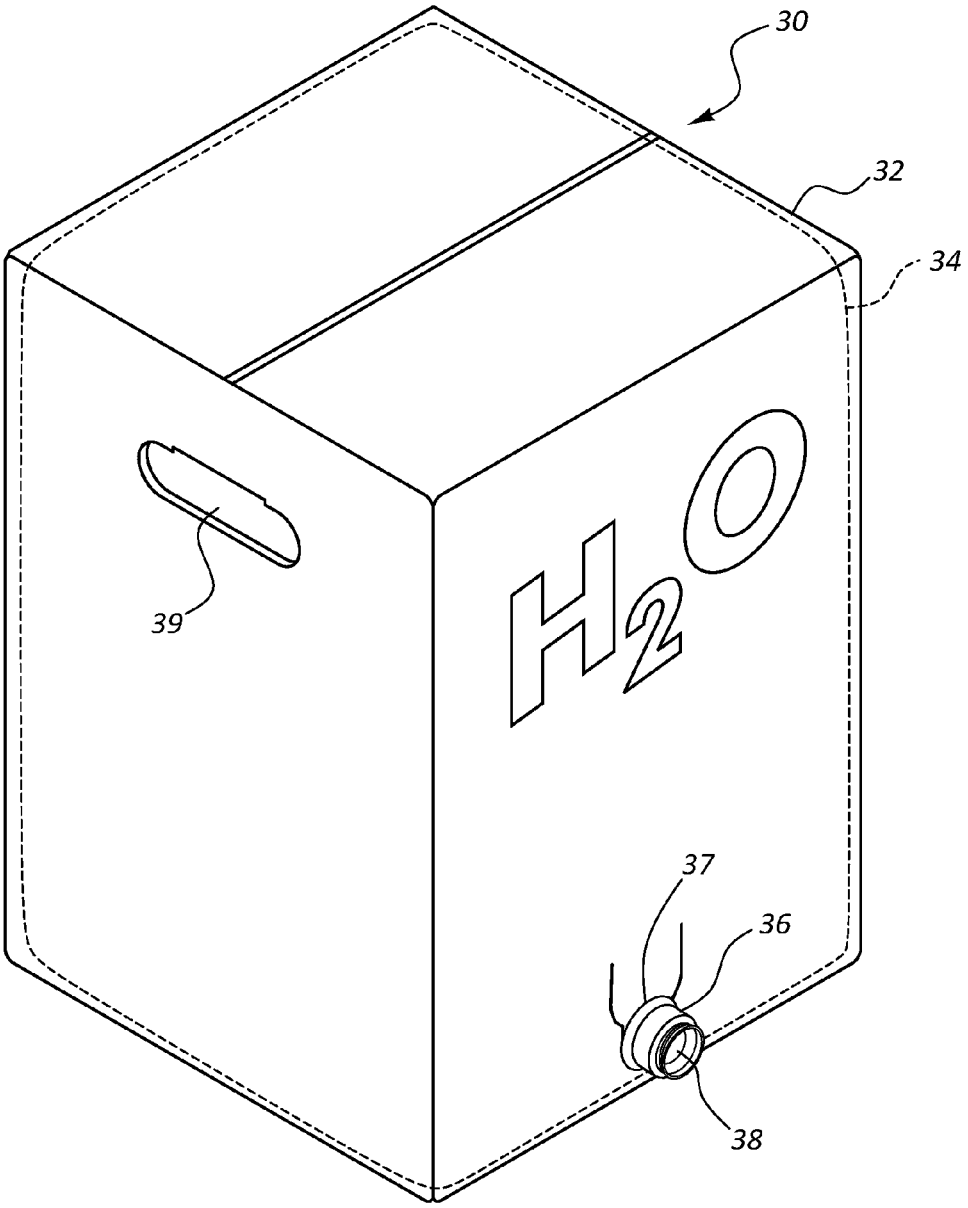
FIG. 2 (Prior Art)
FIG. 2 is a pictorial view of a prior art bag-in-box water container which can be used with the adapter of the invention and showing a bag dispensing fitting extended through the box.

FIG. 2 shows a bag-in-box water container 30 which includes a box 32 having a flexible bag 34 therein, shown in broken lines, and a bag dispensing fitting in the form of a spout fitment 36, located at the bottom of the bag 34 within the box 32 and extending out of an opening 37 in a side of the box adjacent its bottom. There are a number of different dispensing fittings currently in use with bag-in-box containers, the one being illustrated as an example in the illustrated embodiment is a multiple part dispensing fitting made by Liqui-Box Corporation of Worthington, Ohio, as shown in U.S. Pat. Nos. 4,421,146 and 4,445,551, both incorporated herein in their entirety by reference. With this Liqui-Box dispensing fitting, the bag 34 in the bag-in-box container 30 includes the spout fitment 36 sealingly secured to the bag 34. The spout fitment 36 includes a normally closed spout valve member 38 therein which is normally closed to prevent flow of water out of the bag through the spout fitment 36. The bag 34 contained in the box 32 includes this spout fitment 36 and the normally closed spout valve member 38. The spout fitment 36 is positioned inside the box 32 until the bag-in-box container 30 is ready to be used. When ready to be used, the spout fitment 36 is pulled out of the box 32 through opening 37 so as to extend through opening 37 outwardly from the box 32, as shown. Box 32 will usually include handle openings 39 in opposite sides which a user can use to lift and move the bag-in-box container.

Figure 3:
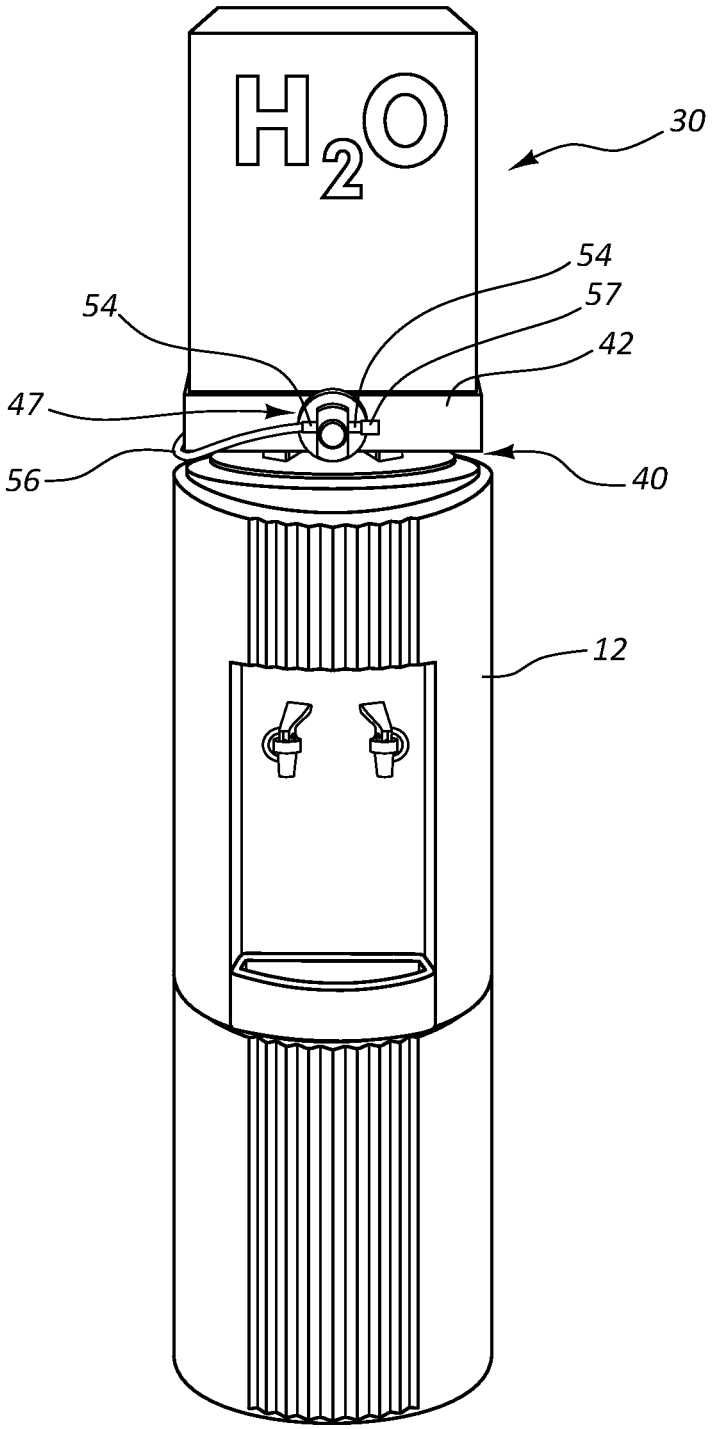
FIG. 3 is a pictorial view of the water cooler of FIG. 1 with the adapter of the invention installed thereon and showing a bag-in-box container as shown in FIG. 2 mounted on the adapter.

FIG. 3 shows applicant's adapter, indicated generally as 40, positioned on the top of the Glacier Water Cooler body 12, in place of the prior art water bottle support assembly 14, and mounting a five gallon bag-in-box water container 30 on top of the Glacier Water Cooler body 12 in place of the five gallon rigid water bottle 16 shown in FIGS. 1A-1C. The bag-in-box water container 30 is mounted on and received by an adapter bag-in-box water container support tray 42 sized and configured to receive and support the bag-in-box container 30 thereon. The illustrated support tray 42 includes back and side tray flanges 44, FIGS. 4, 5, and 7, and front tray flange 45 to hold the bottom of the bag-in-box container 30 received on tray 42 from sliding off of tray 42. The front tray flange 45 includes a slot 46, FIG. 4.

Figure 6:
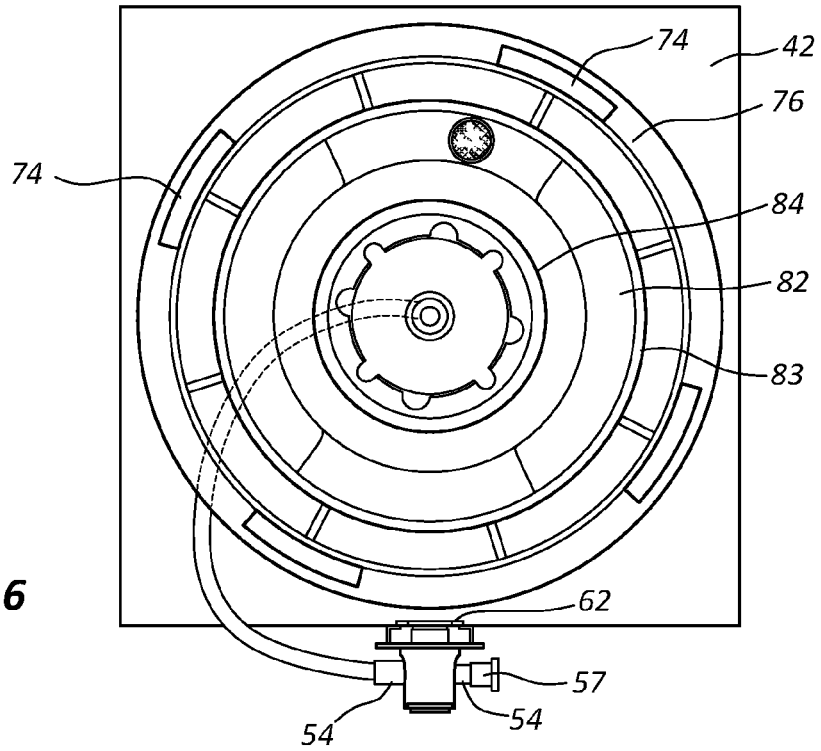
FIG. 6 is a bottom plan view of the assembled parts shown in FIGS. 4 and 5.
Figure 7:
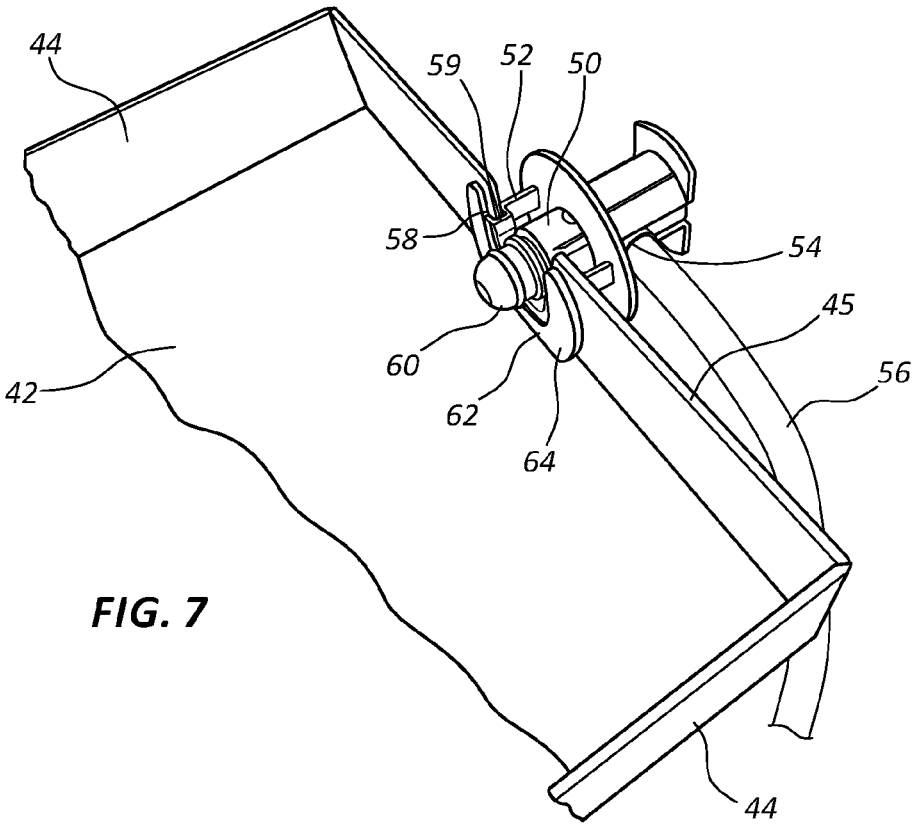
FIG. 7 is a fragmentary pictorial view of a portion of the bag-in-box receiving tray of the adapter of the invention and also showing a bag dispensing fitting connector adapted to mate with a bag dispensing fitting in the bag of the bag-in-box container to attach the bag of the bag-in-box container to the adapter supply hose.

As indicated above in connection with the bag-in-box container 30 shown in FIG. 2, bag 34 includes spout fitment 36 as part of a Liqui-Box multiple part bag dispensing fitting indicated generally in FIG. 3 as 47. When bag-in-box container 30 is ready to be placed on bag-in-box container supporting tray 42, spout fitment 36 is pulled out of the box 32 through opening 37 so as to extend from box 32 as shown in FIG. 2. Rather than doing this before placing the bag-in-box container on the bag-in-box container supporting tray 42, this could be done once the bag-in-box container 30 has been placed on the bag-in-box container supporting tray 42. A separate service line connector 50, FIG. 7, is slidably mounted in a spout clamp 52 and includes two line connectors 54 to connect to service lines to be supplied with water flowing from the bag 34. In the present application, only one of the two line connectors is connected to a supply line, here shown as supply line 56, with the other line connector capped by cap 57, FIGS. 3 and 6. The end portion 58 of spout clamp 52 away from the line connectors is adapted to connect to the extended end of the spout fitment 36 and includes a groove 59 that can slide into slot 46 of front tray flange 45 to hold and stabilize spout clamp 52 and the attached spout fitment 36 extending from the bag-in-box container 30 with respect to adapter bag-in-box water container support tray 42. When mounted in spout clamp 52, service line connector 50 can slide with respect to spout clamp 52 between an extended position wherein the normally closed spout valve member 38 in the spout fitment 36 remains in normally closed condition to prevent flow of water out of the bag, and a retracted position wherein service line connector 50 is pushed along spout clamp 52 toward the bag-in-box container causing end 60, FIG. 7, of service line connector 50 to be pushed into spout fitment 36 to open the normally closed spout valve member 38 to allow the water to flow from bag 44, through the spout fitment 36 into the service line connector 50 and through line connectors 54 into any service lines connected thereto, here single service line 56. This operation is all as described in the cited prior art U.S. Pat. No. 4,421,146.

With this illustrated Liqui-Box dispensing fitting embodiment of the bag dispensing fitting 47, FIG. 3, the spout clamp 52 with service line connector 50, as shown in FIGS.

4, 5, and 7, is reusable. Spout clamp 52 is disconnected from the spout fitment 36 extending from bag 34 when a bag 34 is empty and is connected to a new bag spout fitment 36 extending from a full bag 34 of a replacement bag-in-box container 30.

The adapter of the present invention includes the adapter supply line 56 adapted to connect to an outlet of dispensing fitting 47 to thereby connect the bag of the bag-in-box container with the adapter. With adapter supply line 56 connected to the outlet of the dispensing fitting 47, dispensing fitting 47 can be operated to allow water from the bag-in-box container to flow into adapter supply line 56 and to flow through adapter supply line 56 through the adapter and into the water cooler reservoir. For use with the described Liqui-Box dispensing fitting, the adapter supply line 56 is connected to one of the line connectors 54 of service line connector 50, as shown in, for example, FIGS. 4-7. With the adapter supply line 56 connected to one of a line connector 54, and with the spout clamp 52 connected to spout fitment 36 extending from the bag-in-box container, the service line connector 50 can be moved along spout clamp 52 toward the bag-in-box container in receiving tray 42 to move it to its retracted position to open the spout valve 38 in the spout fitment 36 to allow water from the bag 34 to flow through service line connector 50 and line connector 54 into adapter supply line 56 and through adapter supply line 56 into the water cooler. With this illustrated Liqui-Box dispensing fitting embodiment of the dispensing fitting 47, the bottom of support tray 34 includes a slot 62, FIGS. 4-7, immediately adjacent the front tray flange 45 at the bottom of front tray slot 46 to receive the lower portion of flange 64 of spout clamp 52 therein to allow spout clamp 52 to be properly positioned at the bottom of the bag in the bag-in-box container. This slot 62 may not be necessary, or may need to be modified, depending upon the bag dispensing fitting used with the bag-in-box container used.

Figure 4:
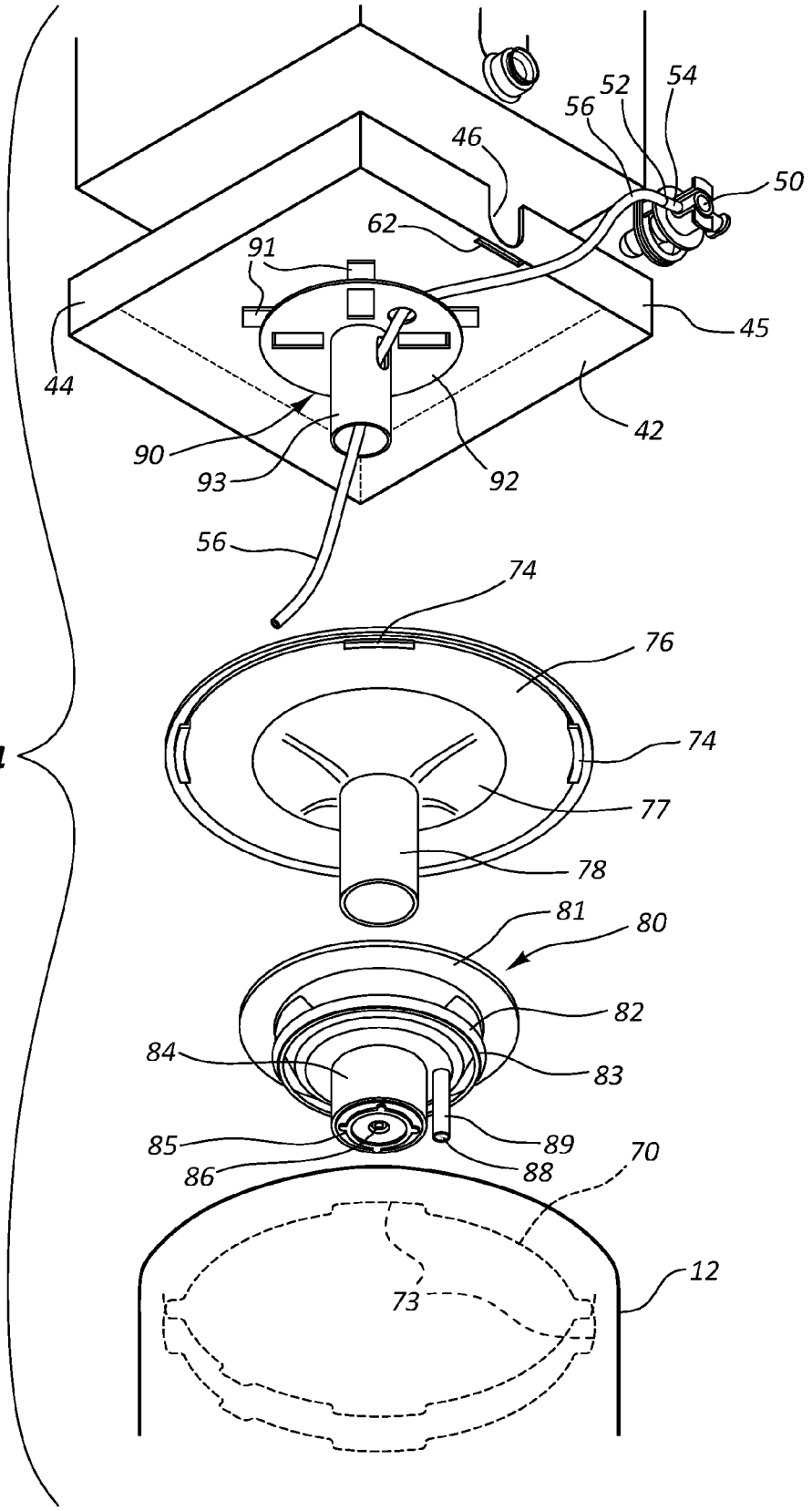
FIG. 4 is an assembly view showing the parts of the adapter of the invention as they fit into the top of the water cooler of FIG. 1.
Figure 5:
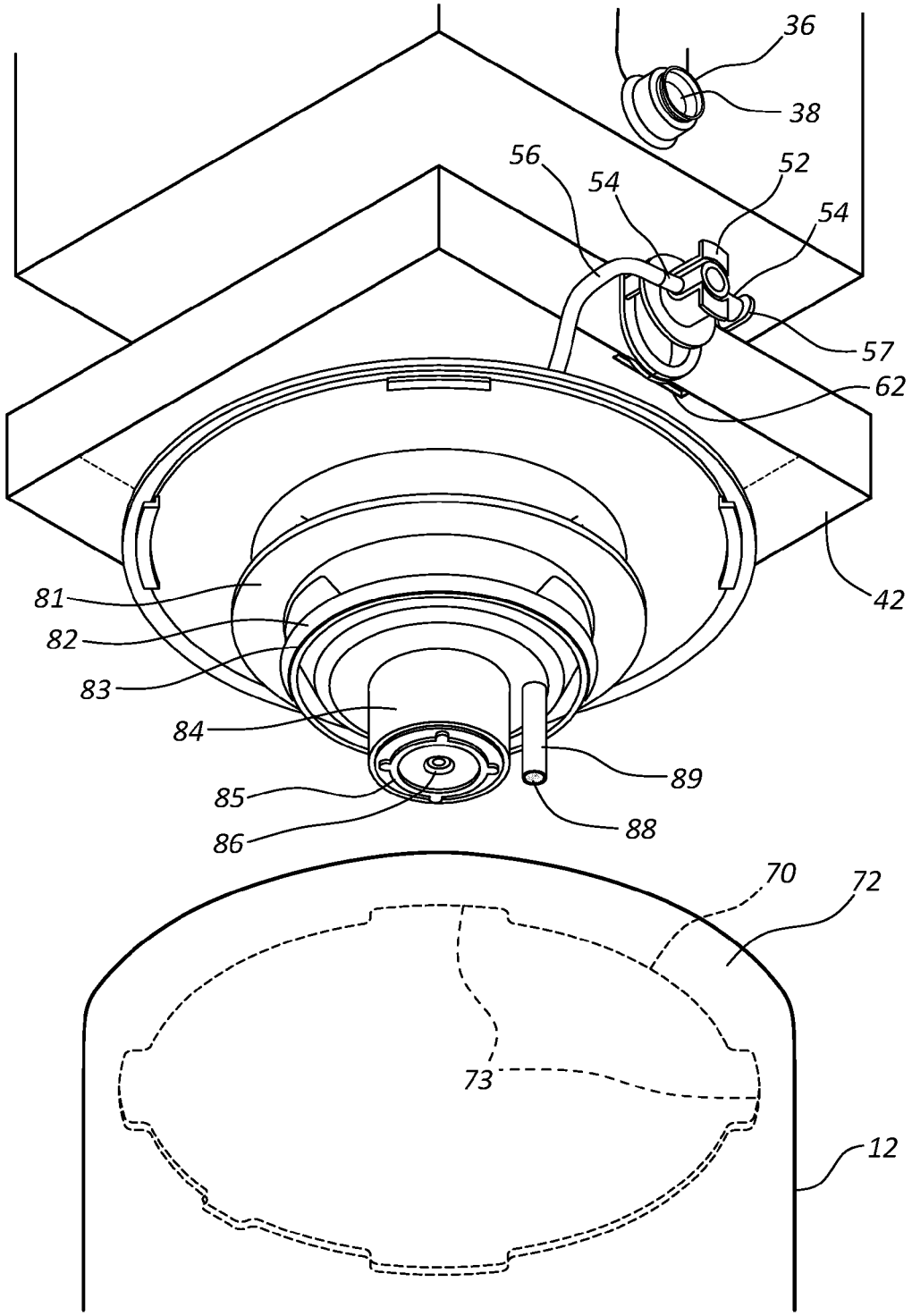
FIG. 5 is an assembly view similar to that of FIG. 4, but showing several of the parts shown in FIG. 4 in assembled condition ready for insertion into the top of the water cooler of FIG. 1.

The general construction of the top of the example Glacier Series water cooler shown in FIG. 1 is illustrated in FIGS. 2 and 3 of referenced U.S. Pat. No. 7,051,902 and shows a water reservoir positioned in the top of the water cooler body 12. FIGS. 4 and 5 herein show water cooler body 12 with top opening 70 above the open top water reservoir, not shown, and forming the open top of the water reservoir. Top opening 70 is encircled by top rim 72 of body 12. Top rim 72 includes receiving recesses 73 for receiving locking tabs 74 extending from top cover 76. Top cover 76 fits over top opening 70 and the edge of top rim 72 with locking tabs 74 initially fitting into receiving recesses 73, and top cover 76 is then rotated to move locking tabs 74 from receiving recesses 73 to a position under top rim 72 to lock top cover 76 in position in the top of body 12. Top cover 76 includes a downwardly extending substantially cone shaped center portion 77 with a lower central cylindrical portion 78 extending further downwardly as shown in FIG. 4. In the prior art embodiment of the water cooler as shown in FIG. 1, the substantially downwardly extending cone shaped center portion 77 receives and supports the top of the rigid water bottle 16 with the narrow neck of the rigid bottle extending into lower central cylindrical portion 78.

The downwardly extending cone shaped center portion 77 and lower central cylindrical portion 78 fit into a reservoir seal assembly 80, FIGS. 4 and 5. Reservoir seal assembly 80 includes a top ring portion 81 which abuts the bottom surface of top cover 76 when cone shaped center portion 77 and lower central cylindrical portion 78 of top cover 76 are received in reservoir seal assembly 80, and a sealing ring 82 with seal 83, FIGS. 4, 5, and 6, that bears against the interior surface of the reservoir when the reservoir seal assembly 80 is received into the open upper end of the reservoir. A central cylindrical extension 84 extends downwardly into the reservoir when the reservoir seal assembly 80 is positioned in the open top of the reservoir. The bottom of central cylindrical extension 84 is sealed by bottom fitting 85 which is sealingly secured in the bottom of central cylindrical extension 84, and includes a water inlet 86. In the prior art embodiment of the water cooler as shown in FIG. 1 (and as shown in detail in FIGS. 2 and 3 of referenced U.S. Pat. No. 7,051,902), bottom fitting 85 included a pin (water bottle opening cap engaging pin 24) for engaging the cap of the rigid water bottle which is received in central cylindrical extension 84 to connect water inlet 86 to the inside of water bottle 16 so that water from water bottle 16 can flow from water bottle 16 through water inlet 86 into the water reservoir. With the adapter of the present invention, water inlet 86 communicates with supply line 56 so that water from the bag-in-box container flows from the bag-in-box container through supply line 56 and through water inlet 86 into the water reservoir 13. A small air vent 88, corresponding to air vent 26 in the illustrated prior art embodiment of FIG. 1C, extends through sealing ring 82, which for the embodiment illustrated in FIGS. 4 and 5, is shown as extended from sealing ring 82 into the reservoir by means of air vent tube 89. It should be noted that, except for the air vent 88, the bottom of the reservoir seal assembly 80 is completely sealed from seal 83 in sealing ring 82 to water inlet 86. Therefore, with reservoir seal assembly 80 in place in the top of the water reservoir, the water reservoir is completely sealed except for the air vent 88 and the water inlet 86. Access to the reservoir is restricted to the flow of water into the reservoir through water inlet 86 and flow of air into and out of the reservoir through air vent 88.

Bag-in-box water container tray 42 is secured to and spaced above mounting fitting 90, FIG. 4, by legs 91 extending from mounting disc 92. Legs 91 may be welded to the bottom of tray 42 or otherwise attached in any suitable manner to the bottom of tray 42.

Mounting tube 93 extends downwardly from mounting disc 92. Mounting disc 92 is sized to fit into the top portion of downwardly extending cone shaped center portion 77 of top cover 76 with mounting tube 93 extending into lower central cylindrical portion 78. Supply line 56 extends from connection to a line connector 54 of dispensing fitting 47, between the bottom of tray 42 and the top of mounting disc 92, through an opening in mounting disc 92 and an opening in the side of mounting tube 93, through mounting tube 93 into and through lower central cylindrical portion 78 of top cover 76. Supply line 56 may extend through mounting tube 93 into and through lower central cylindrical portion 78 of top cover 76, into central cylindrical extension 84 of reservoir seal assembly 80 to where supply line 56 may attach to bottom fitting 85 and water inlet 86. Thus, when dispensing fitting 47 is attached to bag 34, water from bag 34 can flow from bag 34 to water inlet 86 and into the water cooler reservoir.

Figure 13:
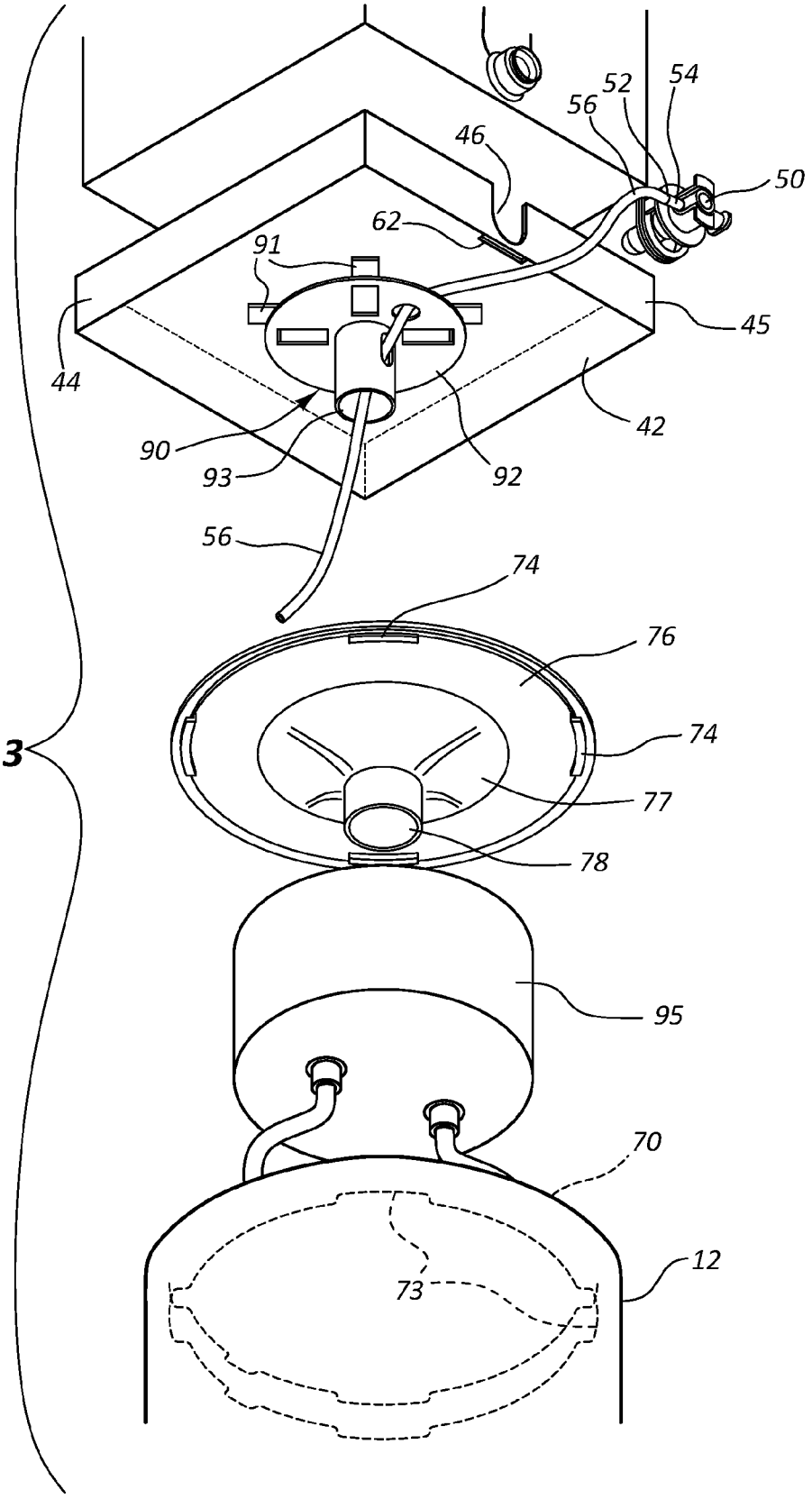
FIG. 13 is an assembly view showing the parts of a further embodiment of the adapter of the invention as they fit into the top of the water cooler of FIG. 1.
Figure 14:
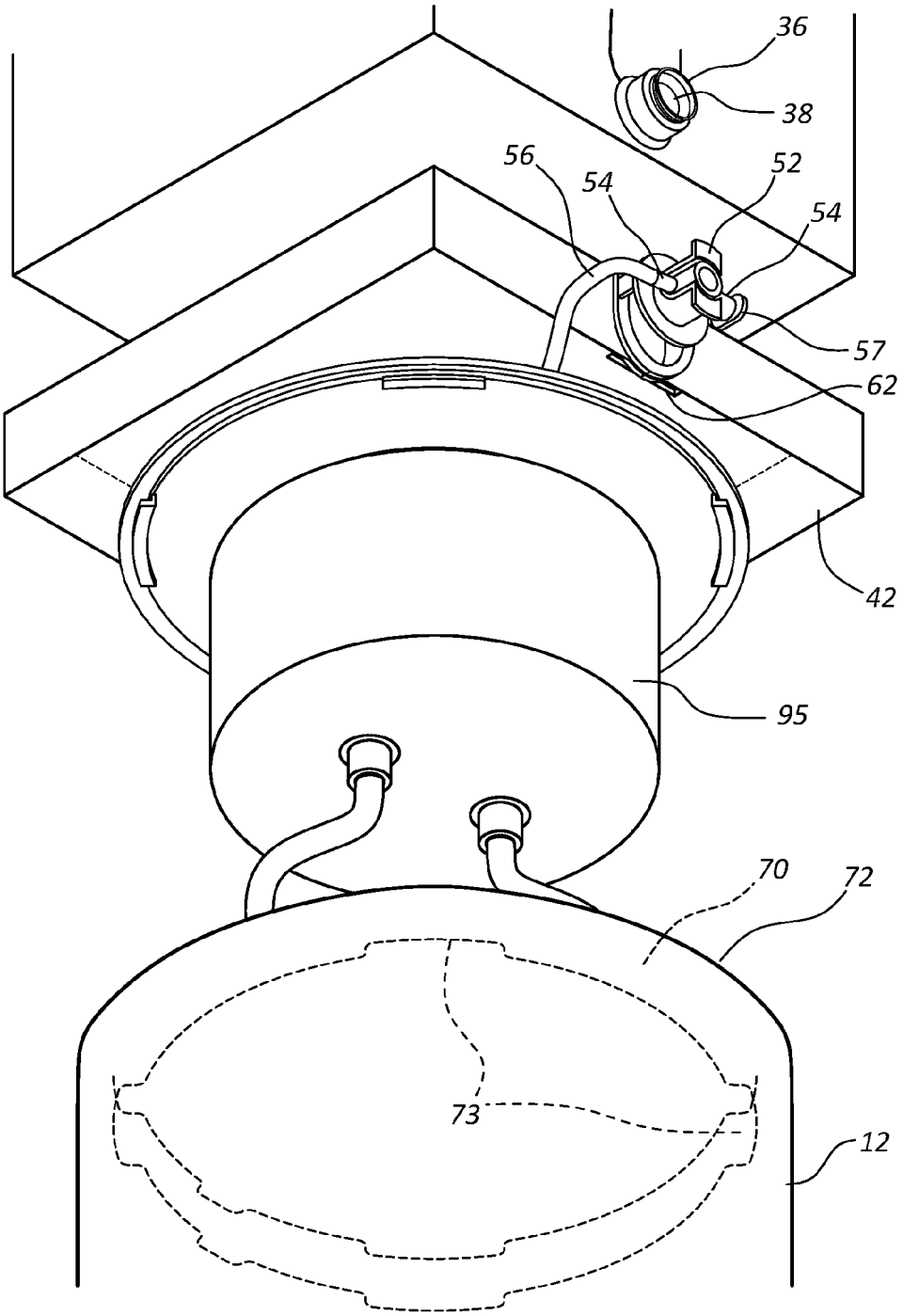
FIG. 14 is an assembly view similar to that of FIG. 13, but showing several of the parts shown in FIG. 13 in assembled condition ready for insertion into the top of the water cooler of FIG. 1.

FIG. 13 is similar to FIG. 4, but rather than showing the reservoir seal assembly 80 and parts thereof separately, FIG. 13 shows schematically and generically a reservoir assembly 95, which for the embodiment of FIG. 4 would include the reservoir seal assembly 80 therein. FIG. 14 is similar to FIG. 5, but rather than showing the mounting disc 90 and related parts, FIGS. 4 and 13, the reservoir seal assembly 80 and parts thereof, FIGS. 4 and 5, separately, FIG. 14 shows schematically and generically the reservoir assembly 95 with the top cover 76, which for the embodiment of FIG. 5 would include the reservoir seal assembly 80 therein, and does not show the mounting disc 90 and related parts which are above and hidden by the top cover 76. However, while the reservoir assembly 95 can include the reservoir seal assembly 80 and parts thereof as shown in FIGS. 4 and 5, such reservoir seal assembly and parts may not be included for other embodiments of the invention, and such reservoir assembly 95 may include various other parts as will be described for additional embodiments of the invention. Similarly, the bag-in-box water container support tray 42 may be supported on top cover 76 in a different manner than as shown in FIGS. 4, 5, and 13.

FIGS. 8A-8E show a schematic cross section representative of a water cooler water reservoir 100 with a reservoir seal assembly 102 therein showing a seal 104 between the inner surface 106 of the water reservoir 100 and the reservoir seal assembly 102, and with supply line 108 extending into reservoir seal assembly 102 and connecting to bottom fitting 110 so as to be connected to the water outlet through bottom fitting 110 into the water reservoir 100. Air vent tube 112 extends from air vent passage 114, FIG. 8A, which vents through a vent fitting 115 extending through reservoir seal assembly sealing ring 116, to communication with the atmosphere through air filter 118. FIGS. 8A-8E illustrate several embodiments of water flow and level control for reservoir 100.

Figure 8A:
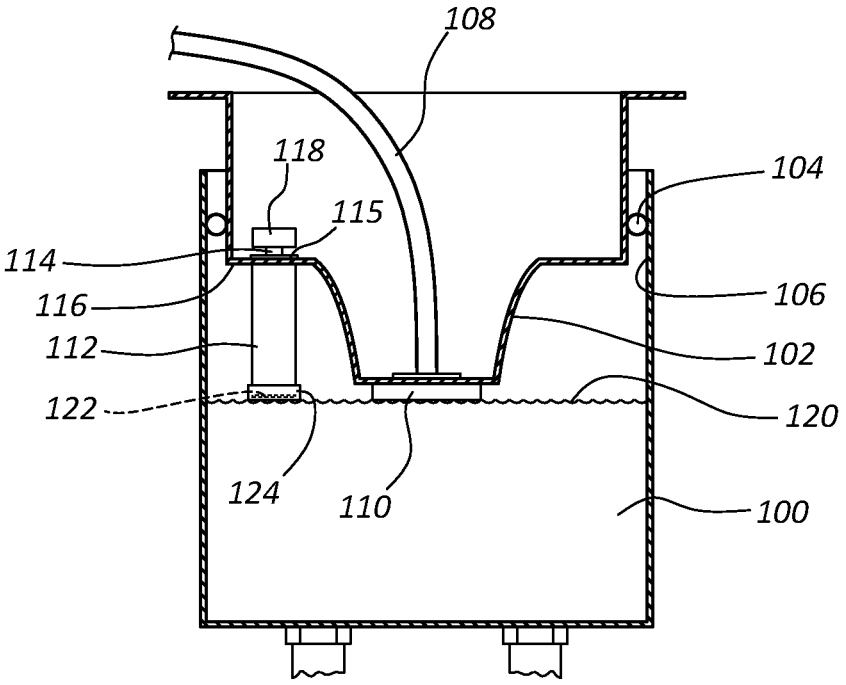
FIG. 8A is a simplified schematic vertical section representing the adapter of the invention installed in the top of the water cooler reservoir and showing a hydrophobic membrane embodiment for control of the venting of the reservoir.
Figure 9A:
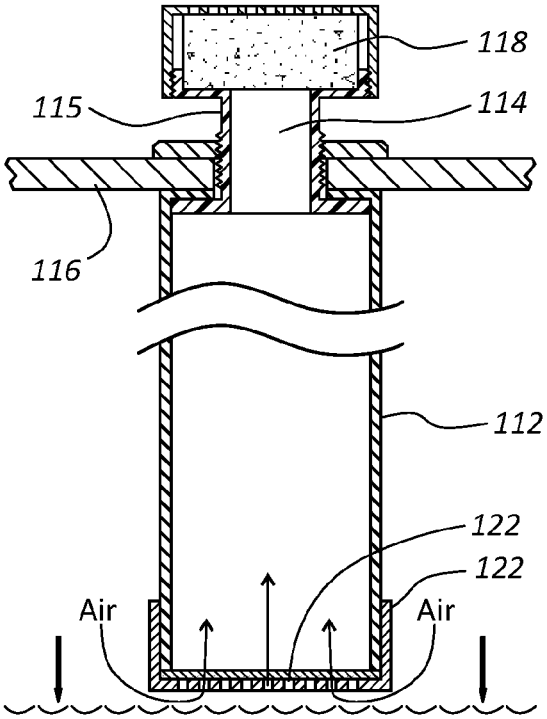
FIG. 9A is a vertical section showing details of the hydrophobic membrane embodiment for control of the venting of the reservoir with the water level below the membrane.
Figure 9B:
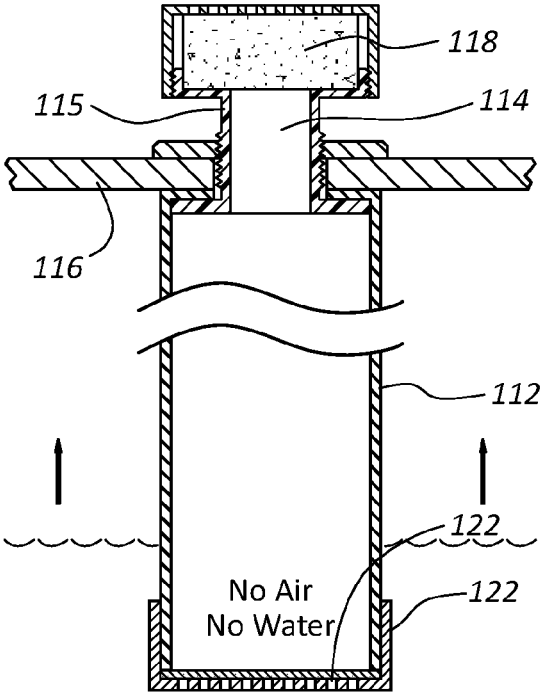
FIG. 9B is a vertical section showing details of the hydrophobic membrane embodiment for control of the venting of the reservoir similar to that of FIG. 9A but with the water level above the membrane.

FIG. 8A shows the water outlet through bottom fitting 110 discharging directly into water reservoir 100. The flow of water into reservoir 100 and the level 120 of water in reservoir 100 is controlled by a hydrophobic membrane material 122 held at the entrance of vent tube 112 by ring 124, see also FIGS. 9A and 9B. Hydrophobic membrane material 122 is a material through which gas, such as air, can flow, but through which a liquid, such as water, cannot flow. An example of such material is an Emflon II Membrane material available from Pall Corporation, Port Washington, N.Y. In this embodiment, when the water level is below the membrane material 122, FIG. 9A, air can escape from the reservoir through the membrane and air vent to allow water to flow into the reservoir. When water covers the membrane material, FIG. 9B, air can no longer flow through the air vent because it is blocked by the water and water cannot flow through the membrane material so cannot flow out the vent. Depending upon the amount of water in the bag of the bag-in-box container, a small amount of water may continue to flow into the reservoir once the water level reaches the membrane and vent outlet as the air pressure builds up in the sealed area of the reservoir above the water to equalize with the atmospheric pressure acting on the bag and water in the bag. This will result in the water level in the reservoir rising slightly above the bottom of tube 112 as shown in FIG. 9B. As water is dispensed from the reservoir and the water level drops below the membrane so that air can again pass through the membrane, water will again flow from the bag into the reservoir.

Figure 8B:
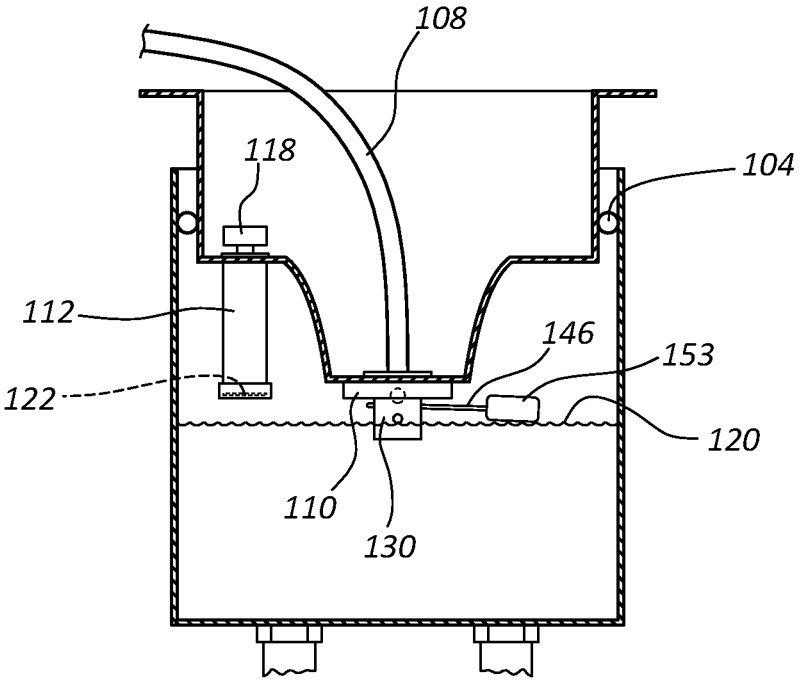
FIG. 8B is a simplified schematic vertical section similar to that of FIG. 8A showing a special float valve that allows high flow capacity at low pressures from the water supply line into the reservoir when the water level in the reservoir is below the desired level in combination with the hydrophobic membrane embodiment for control of the venting of the reservoir.
Figure 12A:
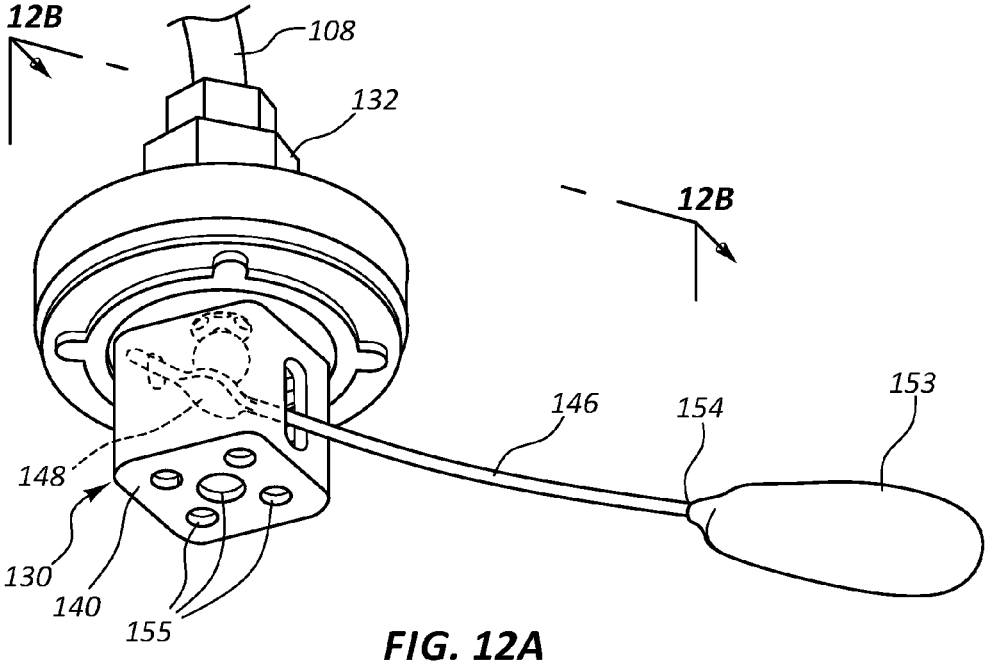
FIG. 12A is a pictorial view of a float valve of the invention.
Figure 12B:
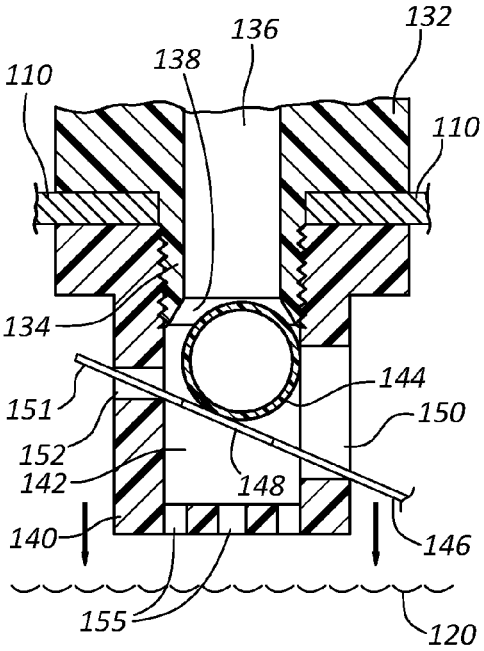
FIG. 12B is a vertical section taken on the line 12B-12B of FIG. 12A showing the water level below the valve housing.
Figure 12C:
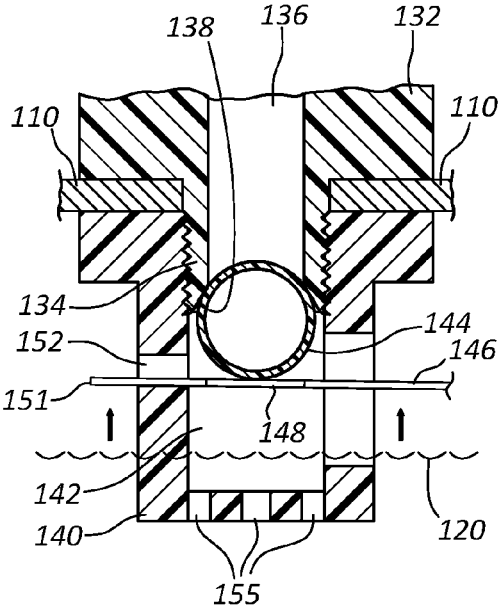
FIG. 12C is a vertical section similar to that of FIG. 12B showing the water level above the bottom of the valve housing.

FIG. 8B shows the flow of water into reservoir 100 and the level 120 of water in reservoir 100 controlled by controlling the flow of water from the water inlet into the reservoir. In the illustrated embodiment of this control, a float valve 130 is provided at the water inlet to the reservoir. Details of a satisfactory float valve 130 are shown in FIGS. 12A, 12B, and 12C. Water outlet fitting 132 with threaded nipple 134 is secured to the end of supply line 108 by connector 135. Threaded nipple 134 fits through an opening in bottom fitting 110. Inlet passage 136 extends through water outlet fitting 132 and nipple 134 with a ball seat 138 at the end of nipple 134. Ball housing 140 forming ball chamber 142 is screwed onto the end of nipple 134 after ball 144 has been placed in ball chamber 142. This sandwiches bottom fitting 110 between water outlet fitting 132 and float housing 140. Gaskets can be positioned between fittings 135 and/or 140 to ensure sealing with bottom fitting 110. Float rod 146 with enlarged flattened portion 148 is inserted through slot 150 so that end 151 of float rod 146 extends through opening 152 of float housing 140 and enlarged flattened portion 148 is positioned under ball 144. Float 153 is attached to end 154 of float rod 146. Float 153 is of somewhat flattened configuration oriented similarly with float rod flattened portion 148 so that float 153 will tend to float in flattened orientation on top of the water in reservoir 100. This will tend to keep float rod flattened portion 148 in flattened orientation under ball 144. In this orientation, flattened portion 148 is transverse to, and will keep float rod flattened portion 148 and float rod 146 in position in float chamber 142 as flattened portion 148 will not pass through slot 150. Float rod 146 can be rotated to align float rod flattened portion 148 with slot 150 to insert or remove the float rod from float chamber 142. As can be seen from FIG. 12B, when the water level 120 in water reservoir 100 is below the bottom of float housing 140, float 153, which floats substantially at water level, is below the bottom of float housing 140, and float rod is in the position shown in FIG. 12B with ball 144 below ball seat 138 so that the valve is open and water is free to flow through inlet passage 136, float chamber 142, and holes 155 in float chamber bottom into the reservoir 100. As the water level rises in reservoir 100, float 153 rises with it until it reaches the position shown in FIGS. 8B and 12C with float rod 146 in the position shown in FIG. 12C. In this position, ball 144 has been raised by float rod flattened portion 148 against ball seat 138 to close inlet passage 136 and stop flow of water into reservoir 100. Unlike a ballcock valve which has restricted slow flow through the valve, particularly at low pressure, this valve arrangement provides a large flow passage when open, FIG. 12B, to allow large flow volume at low pressure. Further, because of this low pressure, the upward float pressure on float rod 146 and flattened portion 148 is sufficient to provide enough upward pressure on ball 144 against valve seat 138 to stop the flow of water into the reservoir. As shown in FIG. 8B, in addition to float valve 130 which directly controls the water flowing into the reservoir and the level of the water in the reservoir, the vent tube 112 with hydrophobic membrane 122 as described for FIG. 8A is still present. While a vent to allow air to flow into and out of the reservoir as the water level varies between the desire level and lower levels is necessary, the hydrophobic membrane is not necessary because the float valve controls the water flow and water level. However, the presence of the hydrophobic membrane provides a safety feature in that if float valve 130 fails to operate for any reason, the hydrophobic membrane over the air vent will stop filling of the reservoir at substantially the level of the membrane to prevent a water overflow from the reservoir through the air vent.

Figure 8C:
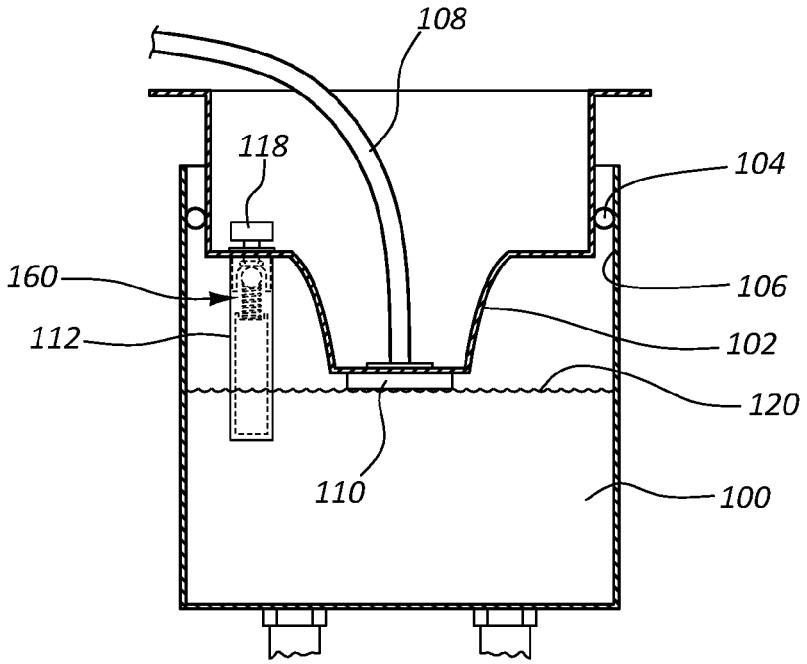
FIG. 8C is a simplified schematic vertical section similar to that of FIG. 8A showing a float valve embodiment for control of the venting of the reservoir.
Figure 11A:
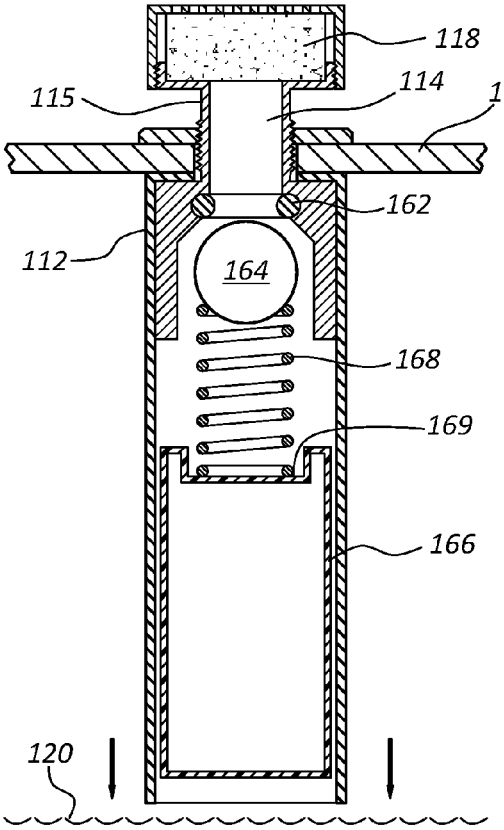
FIG. 11A is a vertical section showing details of the float valve embodiment for controlling the venting of the reservoir as shown in FIG. 8C with the water at a level in the reservoir to open the valve.
Figure 11B:
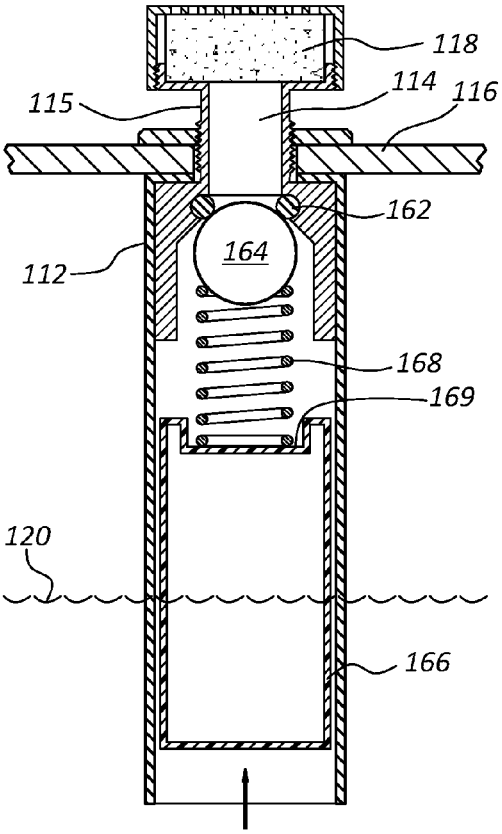
FIG. 11B is a vertical section showing details of the float valve embodiment for controlling the venting of the reservoir as shown in FIG. 8C with the water at a level in the reservoir to close the valve.

FIG. 8C shows the water outlet through bottom fitting 110 discharging directly into water reservoir 100 as shown for FIG. 8A. The flow of water into reservoir 100 and the level 120 of water in reservoir 100 is controlled by a float valve 160 in vent tube 112 which opens and closes the air vent into the reservoir. In the illustrated embodiment of this control, shown in more detail in FIGS. 11A and 11B, air vent passage 114, which vents through vent fitting 115 extending through seal assembly sealing ring 116, includes a seal, such as an O-ring 162, at the lower end of air vent passage 114 to form a ball seat for ball 164. A float 166 is slidably positioned in vent tube 112, with a spring 168 between a float upper end recess 169 and ball 164. As shown in FIG. 11A, when the water level 120 in reservoir 100 is below the bottom of vent tube 112, float 166 is near the bottom of vent tube 112 allowing ball 164 at the upper end of spring 168 to drop below ball seat 162 thereby opening the air vent passage 114 to allow air flow into and out of reservoir 100. When the water level 120 rises, float 166 rises in vent tube 112 to push ball 164 upwardly toward and then against valve seat 162 to close air vent passage 114 and prevent air flow out of reservoir 100. This will cause the air pressure in the top of reservoir 100 to build up as water continues to flow into the reservoir and to stop flow of water into the reservoir as the air pressure in the reservoir equalizes with the atmospheric pressure acting on the bag and water in the bag.

Figure 8D:
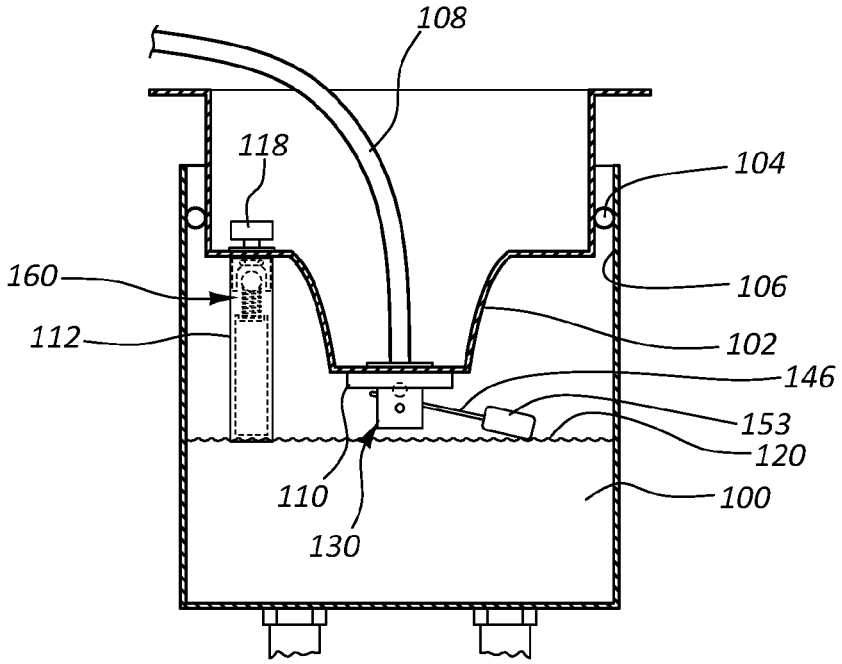
FIG. 8D is a simplified schematic vertical section similar to that of FIG. 8A showing a combination of the special float valve shown in FIG. 8B for controlling water flow from the water supply line and the float valve of FIG. 8C controlling the venting of the reservoir.

FIG. 8D shows the float valve 130 as previously described as the control for water flow into the reservoir and for the water level control, and shows the air vent float valve 160 as previously described as a backup safety feature if water control float valve 130 should malfunction.

Figure 8E:
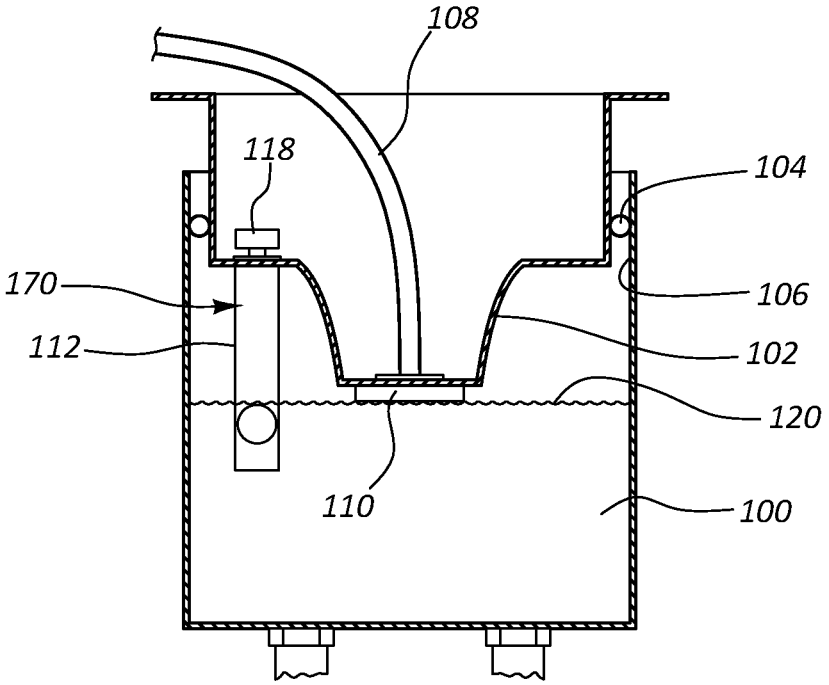
FIG. 8E is a simplified schematic vertical section similar to that of FIG. 8A showing a second embodiment of float valve for controlling the venting of the reservoir.
Figure 10A:
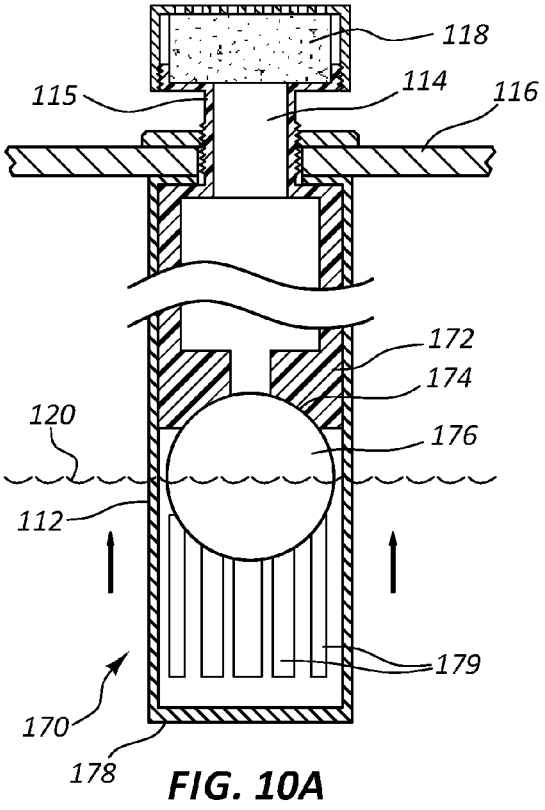
FIG. 10A is a vertical section showing details of the second embodiment of float valve for controlling the venting of the reservoir as shown in FIG. 8E with the water at a level in the reservoir to close the valve.
Figure 10B:
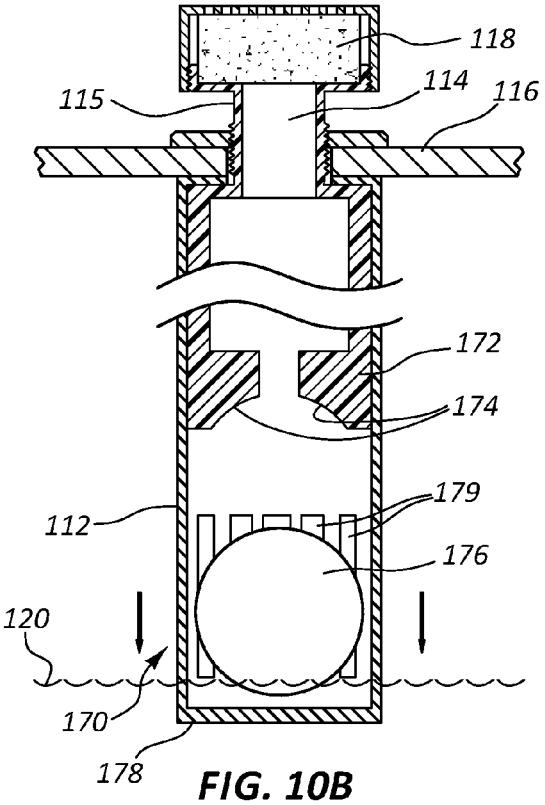
FIG. 10B is a vertical section showing details of the second embodiment of float valve for controlling the venting of the reservoir as shown in FIG. 8E with the water at a level in the reservoir to open the valve.

FIG. 8E shows the water outlet through bottom fitting 110 discharging directly into water reservoir 100 as shown for FIG. 8A. The flow of water into reservoir 100 and the level 120 of water in reservoir 100 is controlled by a second embodiment of float valve 170 in vent tube 112 which opens and closes the air vent into the reservoir. In the illustrated embodiment of this control, shown in more detail in FIGS. 10A and 10B, air vent tube 112 includes an insert 172 in its upper end which forms a ball seat 174 for a float ball 176. As shown in FIG. 10B, when water level 120 is low, ball 176 falls below ball seat 174 to open air vent tube 112 and allow air to flow into and out of reservoir 100. In this embodiment, air vent tube 112 includes a bottom 178 to prevent float ball 176 from falling out of the air vent tube 112 when the water level 120 in reservoir 100 drops well below the bottom of air vent tube 112 as can happen when all of the water in the bag-in-box container is used and the emptied bag-in-box container needs to be replaced with a new full bag-in-box container. Here openings 179 in the lower walls of air vent tube 112 allow air and water to flow into and out of the lower portion of air vent tube 112. When the water level 120 rises in the reservoir, it pushes floating ball 176 upwardly toward and the against ball seat 174 to close air vent tube 112 and prevent air flow out of the reservoir 100. FIG. 10A show the water level 120 pressing float ball 176 against ball seat 174 to close to close air vent tube 112.

While FIGS. 8A-8E show schematically the outlet or discharge end of the supply line 108, (supply line 56 of FIGS. 3-7) connected to bottom fitting 110, which represents bottom 85 with water inlet 86 in FIGS. 4 and 5, various other connection arrangements can be used. For example, as indicated above, the reservoir fitting may be an existing assembly in the top of the water cooler reservoir which includes a water bottle opening cap engaging pin 24, FIG. 1C, adapted to extend through the water bottle opening cap of a substantially rigid water bottle for which the water cooler was designed to be used with. In some instances it may be desirable to leave the water bottle opening cap engaging pin 24 in place in the water bottle adapter 23, FIG. 1C, when adapting the water cooler to use a bag-in-box liquid container in place of the substantially rigid water bottle 16. Leaving the water bottle opening cap engaging pin 24 in place can reduce the modifications that need to be made to the prior art water cooler, can provide easier cleaning of the water cooler, can provide easier assembly and disassembly of the water cooler, and/or provide other advantages depending upon the particular prior art cooler being adapted.

Figure 19:
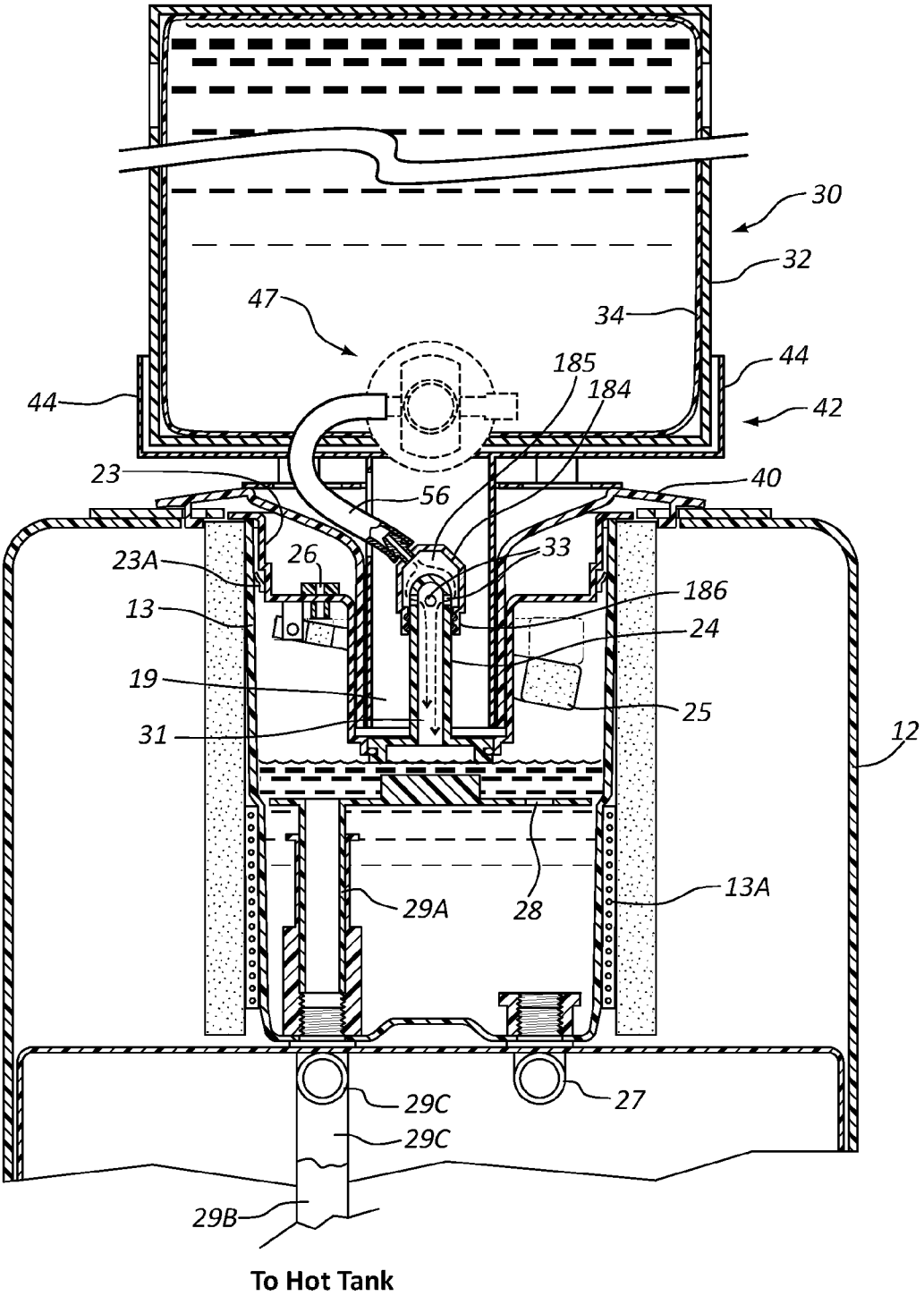
FIG. 19 is a fragmentary vertical section through the upper portion of the prior art water cooler shown in FIG. 1A, similar to FIG. 1C, but showing a bag-in-box liquid container in place of the substantially rigid water bottle with connection of a water supply line from the bag-in-box liquid container connecting to a water bottle opening cap engaging pin.
Figure 20:
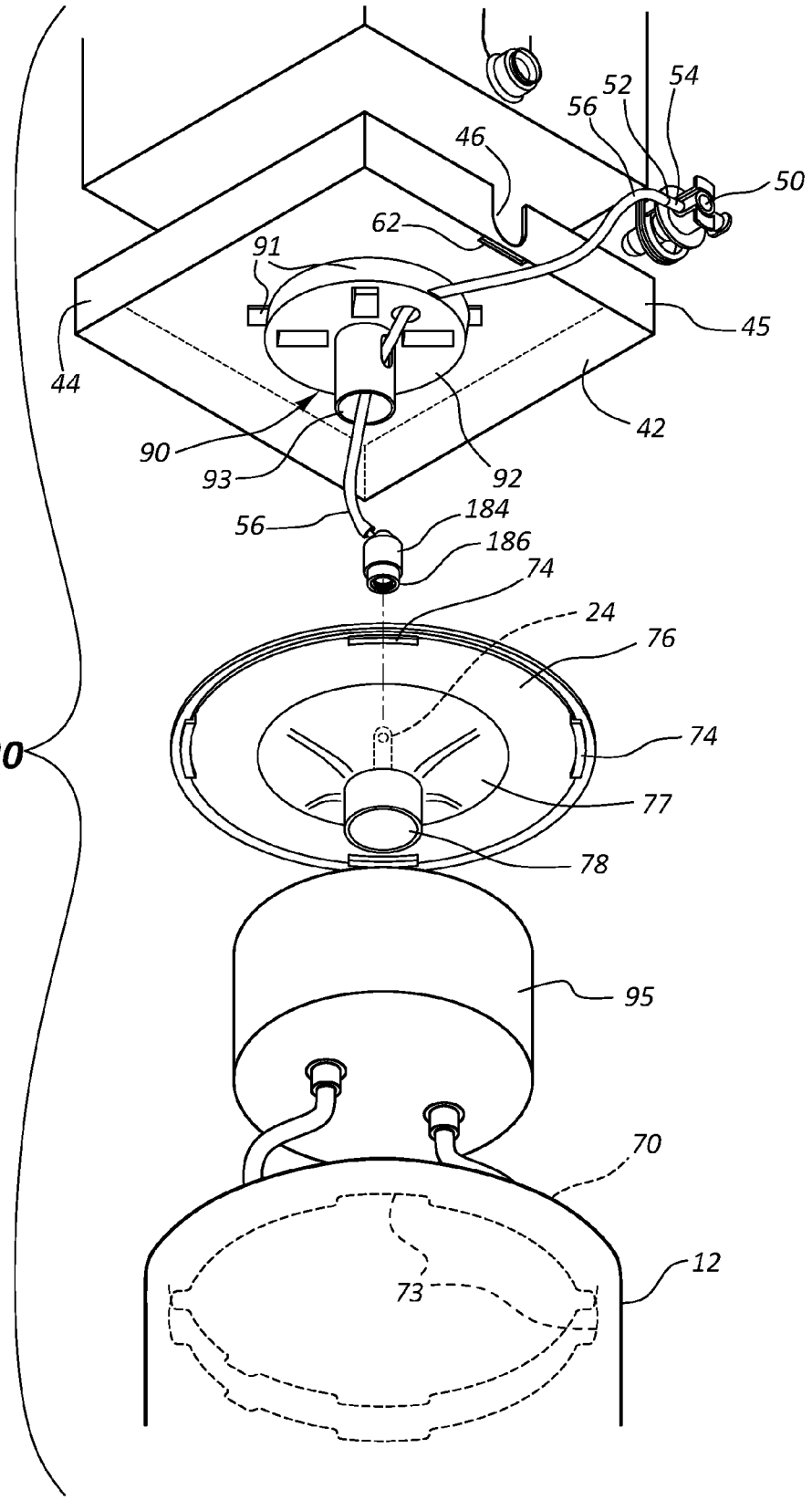
FIG. 20 is an assembly view showing the parts of a further embodiment of the adapter of the invention similar to FIG. 13, and showing a fitting for attaching to a water bottle opening cap engaging pin.
Figure 22:
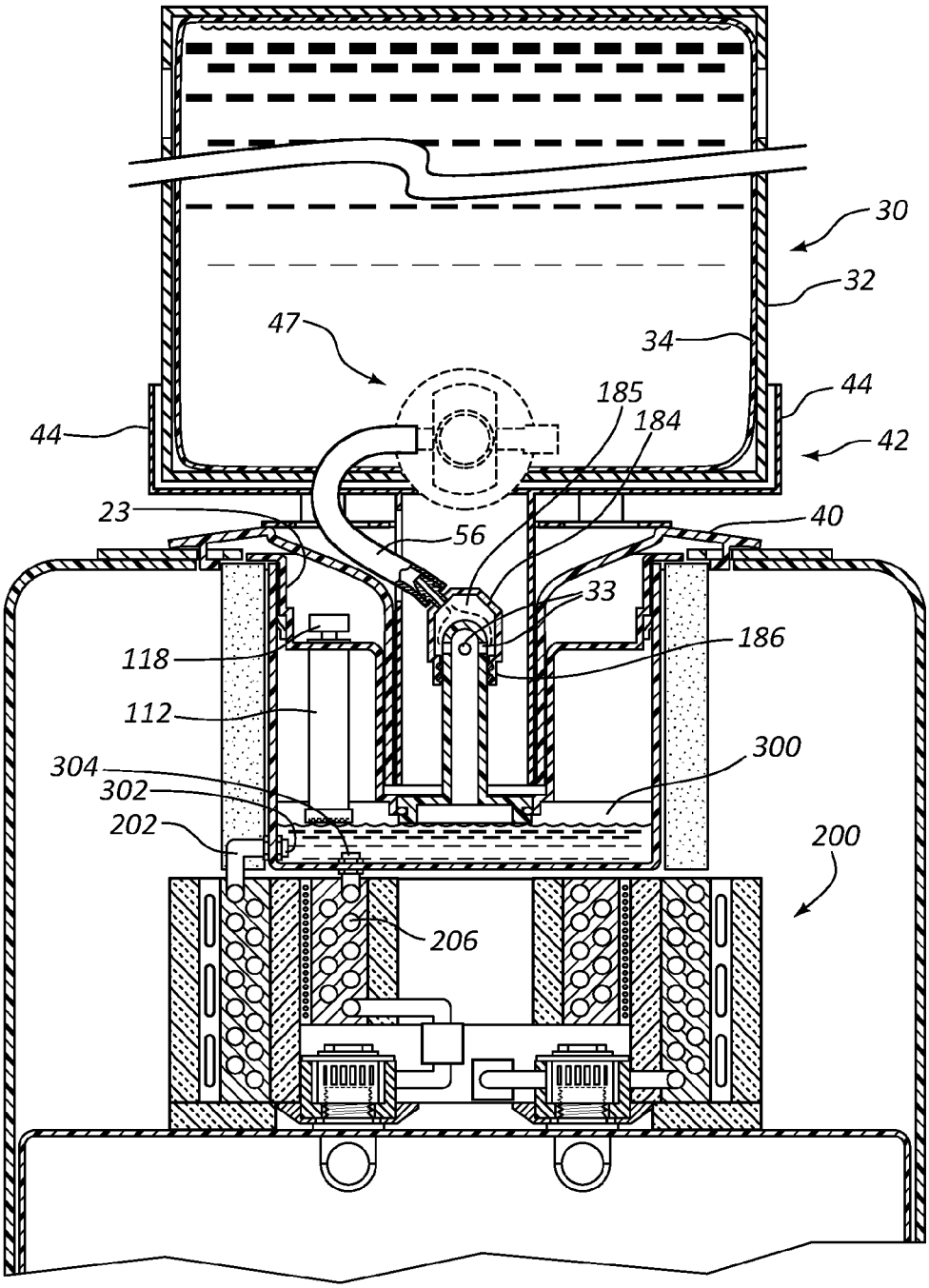
FIG. 22 is a fragmentary vertical section through the upper portion of the prior art water cooler of FIG. 1A, similar to FIG. 18 but showing a bag-in-box liquid container in place of the substantially rigid water bottle with connection of a water supply line from the bag-in-box liquid container connecting to a water bottle opening cap engaging pin and showing the level control of FIG. 8A.

FIG. 19 shows the prior art water cooler of FIGS. 1A, 1B, and 1C converted to hold a bag-in-box liquid container 30 on top of the cooler body 12. FIG. 19 is similar to FIG. 1C except for the change from the substantially rigid water bottle to the bag-in-box liquid container. The water bottle support assembly 14 and the water bottle adapter 23 are the same as when the substantially rigid water bottle was used and the water bottle opening cap engaging pin 24 remains. In the embodiment of the invention shown in FIG. 19, the discharge end of the supply line 56 as described for previous embodiments is connected to an adapter fitting 184 that fits over the upper end of the water bottle opening cap engaging pin 24 to provide a liquid chamber 185 around the openings 33 connecting to the pin passage 31. Seal 186 at the lower end of adapter fitting 184 seals liquid chamber 185 to prevent leakage down the outside of the water bottle opening cap engaging pin 24. All liquid flowing through liquid supply line 56 is directed into liquid chamber 185 to flow through openings 33 into pin passage 31 and through pin passage 31 into water reservoir 13. FIG. 20 is similar to FIG. 13, but shows water bottle opening cap engaging pin 24 in assembly view as it would be in the lower cylindrical portion 78 when assembled into the reservoir assembly 95. FIG. 20 shows adapter fitting 184 on the end of supply line 56 as the supply line 56 would be inserted into water reservoir 95 and attached over the upper end of adapter fitting 184. With the adapter fitting as shown in FIG. 22 on the end of supply line 56, the supply line 56 can be easily attached to or removed from the end of water bottle opening cap engaging pin 24.

While this attachment to the water bottle opening cap engaging pin 24 provides water to water reservoir 13, as previously explained, since bag 34 is flexible and collapses as the water drains from the bag, the invention requires a means for controlling the flow of liquid from the supply line 56 into the reservoir 13 to control the level of water in the reservoir 13. While not provided for this purpose, as previously mentioned, this particular embodiment of prior art shown in FIG. 1C provides a safety feature to prevent over flow of water from the cooler in the event of a hole in bottle 16 which allows air to flow into bottle 16 and water to flow from bottle 16 regardless of whether air can flow into bottle 16 from reservoir 13. With this safety feature, if water in reservoir 13 rises to float 25, it will cause float 25 to close vent 26 and stop further flow of water into the then sealed reservoir 13. If this safety feature works properly, vent 26 is closed as the water level reaches vent 26 so water cannot flow through vent 26 and reservoir 13 is sealed. This will control the water level in reservoir 13 at the level of vent 26. This should allow the prior art water cooler to operate in the manner of the invention. When water is withdrawn from the reservoir, the water level and float 25 will fall and vent 26 will be opened to allow water to flow from the bag-in-box liquid container to again fill the reservoir to full capacity. However, as indicated, this closure is designed for and provided to operate only in emergency situations to prevent overflow of water if the substantially rigid water bottle 16 develops a hole therein. It is not used for normal control of water flow from the substantially rigid water bottle 16 normally used with this water dispenser and normal water level as designed for this water cooler is much lower in the reservoir at the bottom outlet of the passage 31 through water bottle opening cap engaging pin 24. The reservoir 13 would be constantly over filled, however, the water cooler would work with the bag-in-box water container.

Figure 21:
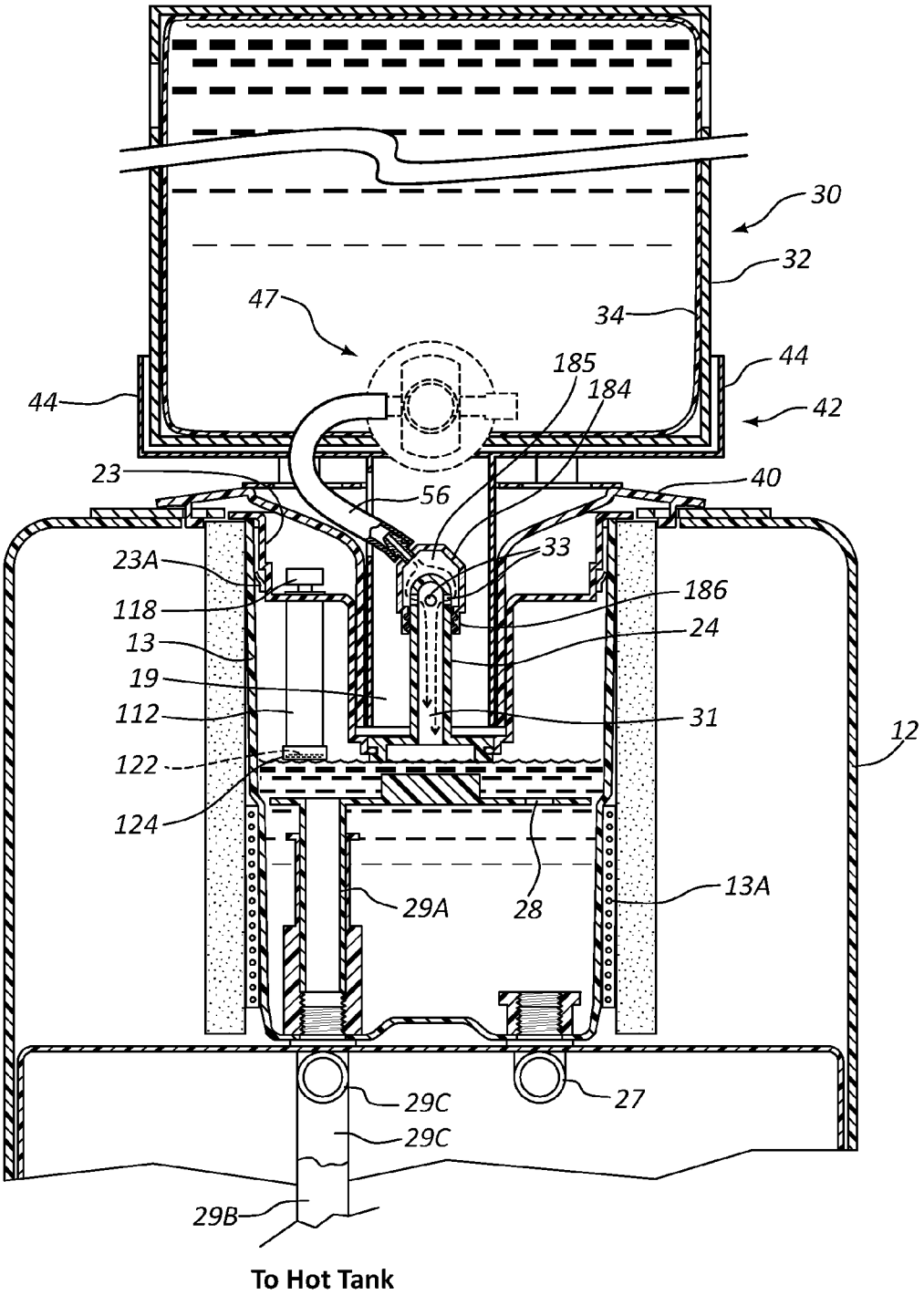
FIG. 21 is a fragmentary vertical section through the upper portion of the prior art water cooler shown in FIG. 1A, similar to FIG. 19, and showing the level control of FIG. 8A.

FIG. 21 shows the prior art water cooler of FIG. 1C modified as shown in FIG. 19 to mount a bag-in-box liquid container, and shows a further modification to provide a flow and level control of the invention as shown and described for FIGS. 8A and 8B which uses a hydrophobic membrane 122 in conjunction with a vent tube 112 to provide flow and level control. Rather than the hydrophobic control as described for FIGS. 8A and 8B, any of the flow and level controls as shown in FIGS. 8A-12C and/or described in the application, or equivalents, can be used.

With the embodiments of the adapter described above, the water reservoir or reservoirs as provided in the prior art water cooler being adapted to use with a bag-in-box liquid container are used and, if the prior art water reservoirs are not already sealed or sealable, as is the case in many or most of the prior art water coolers, in most embodiments of the adaption, the existing water reservoirs will be sealed or made sealable as part of the adaptation. With such arrangements, it is necessary to provide for control of the flow of water from the bag of the bag-in-box container into the reservoir and generally to control the level of the water in the reservoir. In the embodiments shown, this control is provided by valves in the flow path from the bag-in-box container to the water reservoir or by confining the water to within the sealed reservoir. The cooling and/or heating of the water is provide in normal manner by the cooling reservoir and/or heating reservoir as provided in the prior art water cooler being converted.

Figure 15:
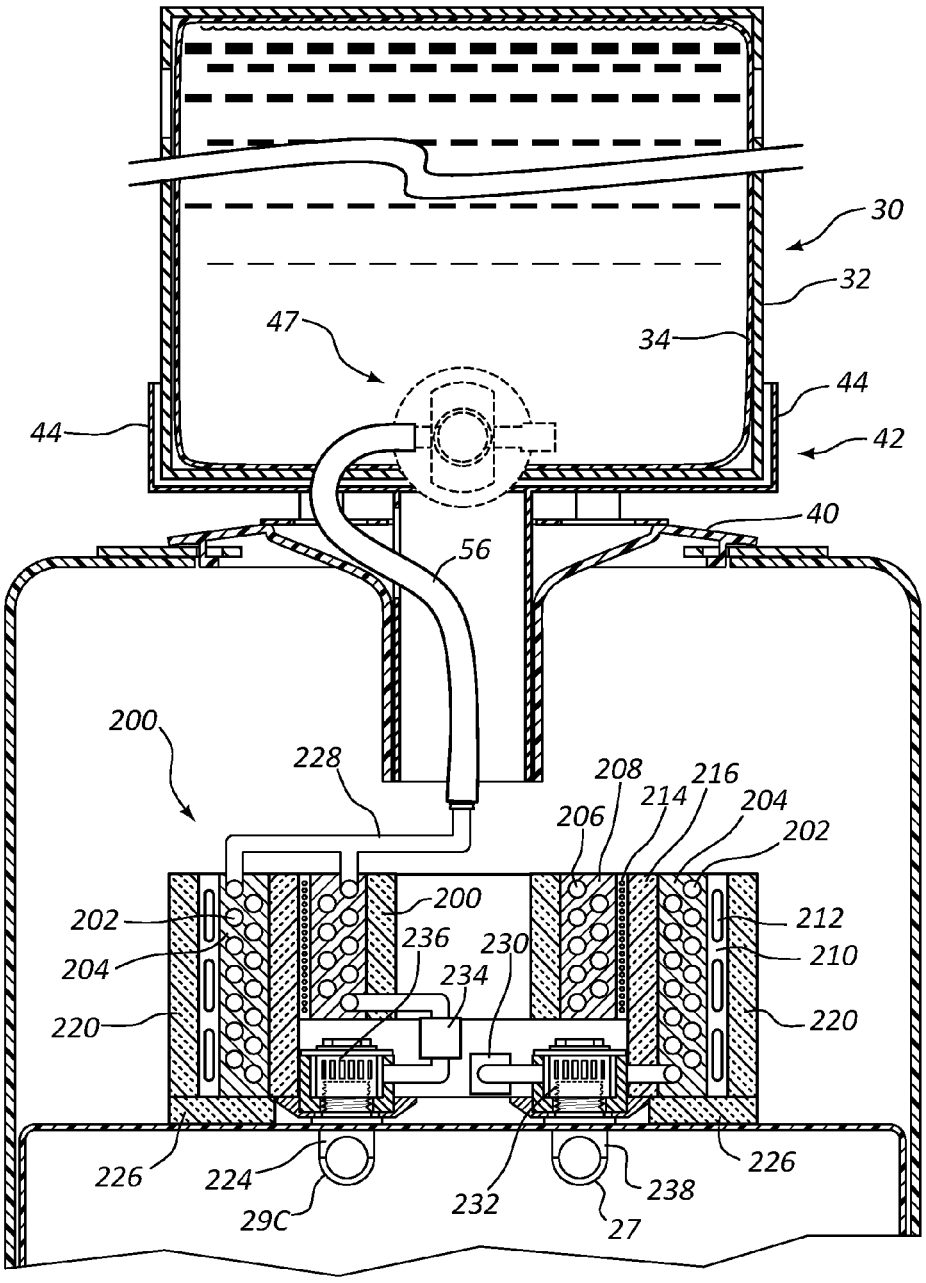
FIG. 15 is a fragmentary vertical section through the upper portion of the prior art water cooler of FIG. 1A with the adapter of FIGS. 13 and 14 installed showing the arrangement of the adapter of FIGS. 13 and 14.

In further alternate embodiments of the invention, a replacement reservoir in the form of a flow passage through a heat exchange block can be provided which can cool or heat water while in the passage or while flowing through the passage. FIG. 15 shows such an adaption wherein the cooled water reservoir and/or the heated water reservoir supplied with the original water cooler is replaced by a replacement reservoir in the form of a heat exchange block, indicated generally by reference number 200, having a liquid cooling passage 202 in a spiral configuration through a ring of high heat capacity material 204 such as a metal or clay, and a liquid heating passage 206 in a spiral configuration through a similar ring of high heat capacity material 208. Such passages along with the inlet and outlet can be formed of stainless steel tubing (acceptable for food applications) with the ring of high heat capacity material, such as aluminum, cast over the stainless steel tubing. A cooling element 210, such as a high heat conductive material such as a metal, with passages 212 for cooled gas from a standard refrigeration unit used in water coolers, not shown, is wrapped around the outside of ring 204 in order to cool ring 204. A temperature sensor, not shown in FIG. 15 but shown as 280 in FIG. 17, in the material forming ring 204 provides feedback to a refrigeration unit control to control cooling of the cooling element in standard manner for a water cooler cooling reservoir. A heating element 214, such as a silicone material with electrical resistance heating wires 216 therein, is wrapped around the outside of ring 208 in order to heat ring 208. A temperature sensor, not shown in FIG. 15 but shown as 284 in FIG. 17, in the ring 208 provides feedback to a heating circuit control to control heating of the heating element 214 in standard manner for a water cooler heating reservoir. Insulation rings 220, 222, 224, and 226 are provided around the outside of cooling element 210, between ring 204 and heating element 214, around the inside of ring 208, and under heat exchange block 200, respectively. Liquid from the bag 34 of the bag-in-box liquid container 32 flows from the bag through supply line 56 and though manifold 228 to cooling passage 202 and heating passage 206. Water from cooling passage 202 flows through connectors 230 and 232 into cold water outlet tube 27 to cooled water discharge valve 22 and water from heating passage 206 flows through connectors 234 and 236 into hot water outlet tube 29C to hot water discharge valve 20. While various connectors can be used, connectors 232 and 236 shown provide connection to the female ends of connectors 238 and 240 provided with the particular prior art Glacier Series water cooler embodiment shown for illustration purposes in FIG. 15. The flow passages for the liquid from the bag in bag-in-box container 32 through the supply line 56, the heat exchange block 200, and out through tubes 27 and 29C to water discharge valves 22 and 20 is completely closed so water will not flow from the bag 34 unless one of the water discharge valves 20 or 22 is opened. No other valves are needed to control flow. This simplifies the control of water flow in the water cooler. In addition, heat exchange block 200 replaces both the cooling reservoir and the separate heating reservoir provided in prior art water coolers which provide hot water as well as cold water.

Figure 16:
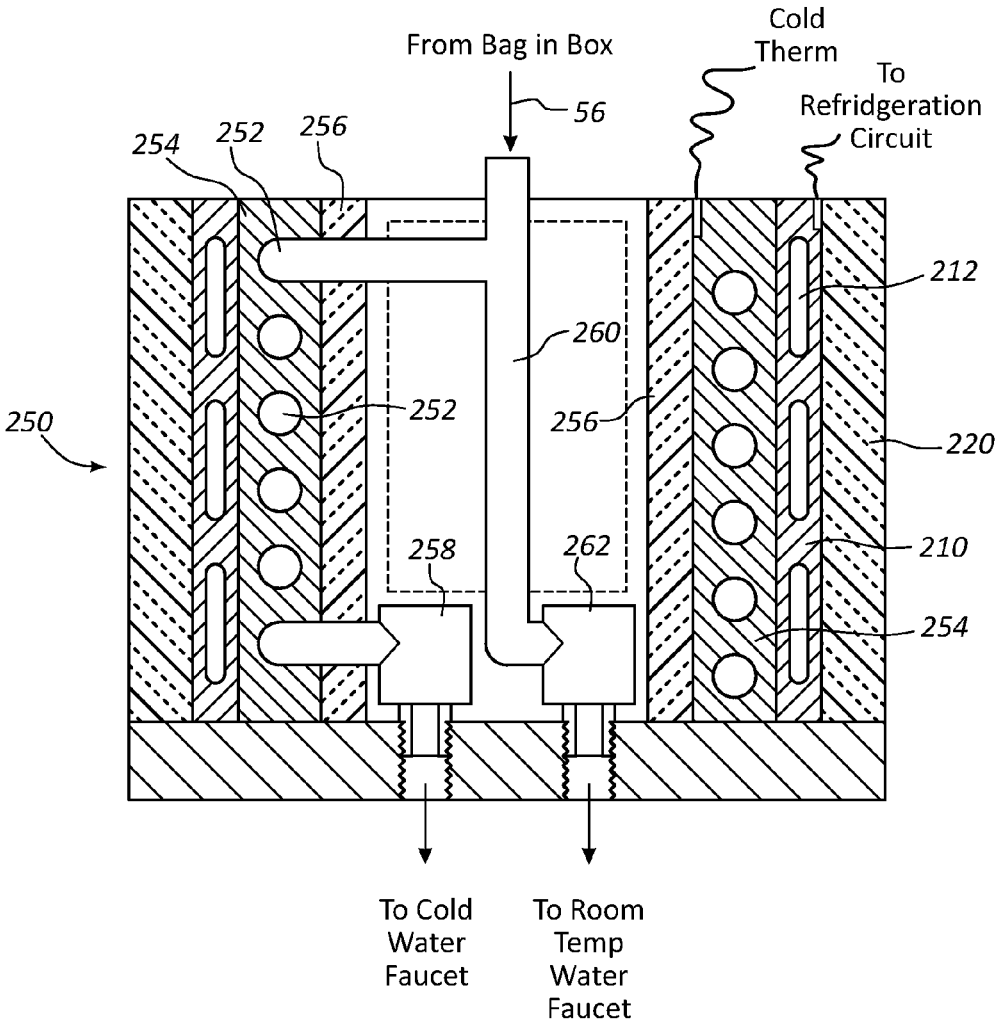
FIG. 16 is a vertical section through a heat exchanger of the invention providing cooled water and room temperature water.

FIG. 16 shows an embodiment of a heat exchange block 250 which provides water cooling and, rather than water heating, provides room temperature water through a room temperature discharge valve which replaces the hot water discharge valve. A number of prior art water coolers provide cooled water and room temperature water, rather than hot water. In the embodiment of FIG. 16, a cooling passage 252 is provided in a ring of high heat capacity material 254 with cooling element 210 wrapped around the outside of ring 254. Insulation ring 220 is provided around the outside of cooling element 210 and insulation ring 256 is provided around the inside of ring 254. The outlet of cooling passage 252 is connected to a cooled water outlet tube, not shown, such as cooled water outlet tube 27 of FIG. 15, through connector 258. Stainless steel passage 260 extends without cooling or heating through the center of heat exchange block 250 to connection through connector 262 to a water outlet tube that connects to a room temperature discharge valve, which usually would correspond to the hot water discharge valve 20 since there is no hot water. Water from the bag of the bag-in-box liquid container enters the inlet of the passages 252 and 260 through supply line 56, not shown.

Figure 17:
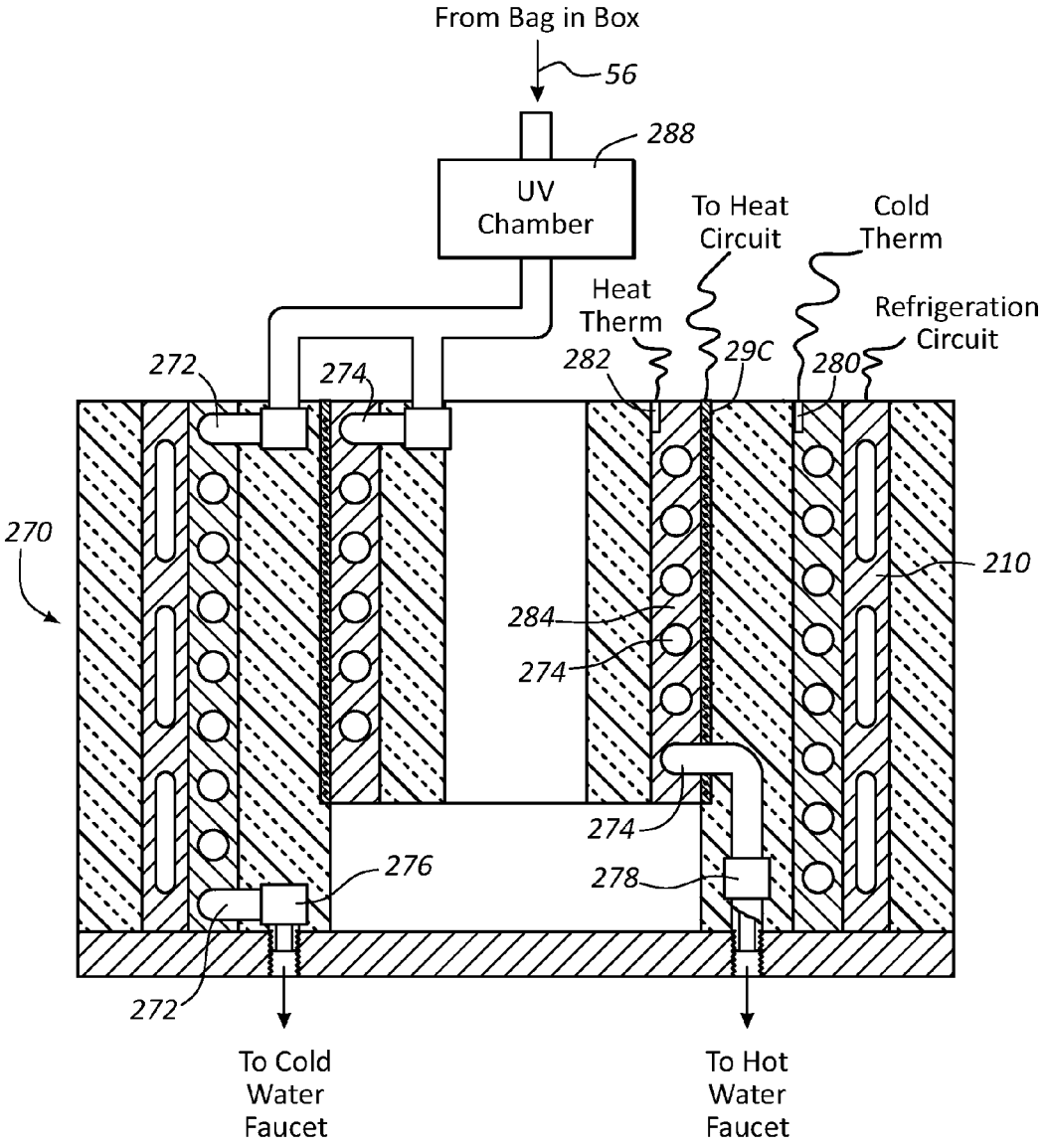
FIG. 17 is a vertical section through a heat exchanger of the invention providing both cooled water and heated water.

FIG. 17 shows a heat exchange block 270 similar to heat exchange block 200 of FIG. 15 with both a liquid cooling passage 272 and liquid heating passage 274, but showing liquid cooling passage 272 and liquid heating passage 274 each in the form of a single vertical spiral rather than having alternating wider and narrower width spiral coils as in FIG. 15. Further, the connections to the respective water outlet tubes are shown more generically with connectors 276 and 278 without the special connectors to the particular example outlet tube connectors shown in FIG. 15. In addition, temperature sensor 280 is shown in ring 282 to measure the temperature of the high heat capacity material surrounding the liquid cooling passage 272 and temperature sensor 282 is shown in ring 284 to measure the temperature of the high heat capacity material surrounding the liquid heating passage 274. As indicated in connection with FIG. 15, such temperature sensors provide feedback to a refrigeration unit control to control cooling of the cooling element 210 in standard manner for a water cooler cooling reservoir and provide feedback to a heating circuit control to control heating of the heating element 214 in standard manner for a water cooler heating reservoir. In addition, a UV Chamber 286 is provided in the water inlet passage to the heat exchange block to sterilize the water entering the heating and cooling passages of the heat exchange block.

Figure 18:
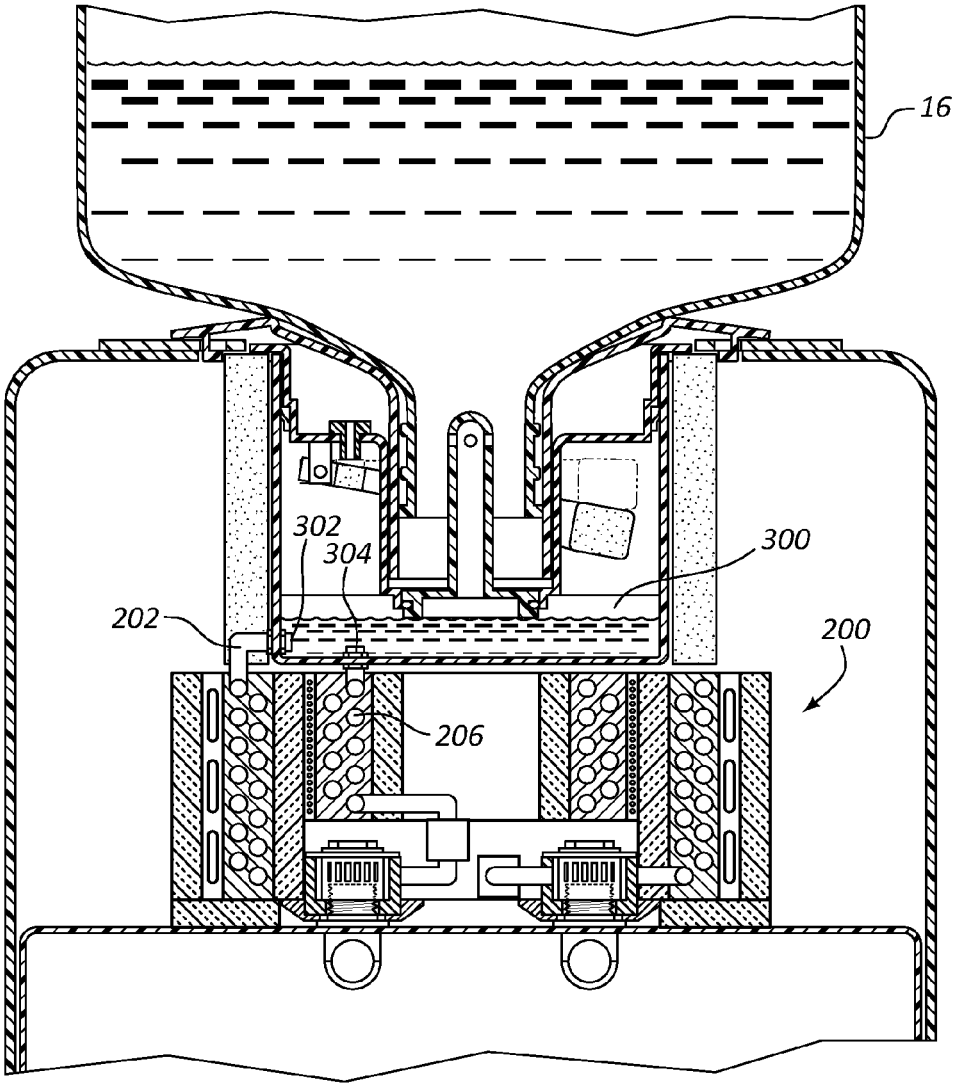
FIG. 18 is a fragmentary vertical section through the upper portion of the prior art water cooler of FIG. 1A, similar to FIG. 1C, showing the prior art substantially rigid water bottle of FIG. 1C with the reservoir of the invention as shown in FIGS. 13, 14, and 15.

The heat exchange block of the invention is not limited to use with the bag-in-box liquid supply of the invention, but can be used in a conventional prior art water cooler in place of the conventional water cooling reservoir and water heating reservoir. Thus, FIG. 18 shows the prior art rigid water bottle source of water as shown in FIG. 1C, with the heat exchange block reservoir 200 of FIG. 15 used in place of the heating and cooling reservoirs of the prior art embodiment of FIG. 1C. Since the water source of the embodiment of FIG. 18 is the rigid water bottle 16, a water reservoir 300 is provided to provide the prior art water flow control from the rigid water bottle 16. This water flow control is described in connection with FIGS. 1A-1C and maintains water in water reservoir 300 as long as water remains in water bottle 16. In the embodiment of FIG. 18, an inlet 302 to the liquid cooling passage 202 of heat exchange block 200 opens into reservoir 300 so that the water in reservoir 300 flows by gravity into liquid cooling passage 202. An inlet 304 to liquid heating passage 206 of heat exchange block 200 also opens into reservoir 300 so that the water in reservoir 300 flows by gravity into liquid heating passage 204. As indicated for FIG. 15, the outlet of liquid cooling passage 202 is connected to cooled water discharge valve 22 and the outlet of liquid heating passage 206 is connected to hot water discharge valve 20. Therefore, upon opening of cooled water discharge valve 22 by a user, cooled water stored in liquid cooling passage 202 flows from cooled water discharge valve 22 and water form reservoir 300 which flows into and through liquid cooling passage 202 is cooled as it flows through the liquid cooling passage 202. Upon opening of hot water discharge valve 20 by a user, heated water stored in liquid heating passage 206 flows from hot water discharge valve 20 and water form reservoir 300 which flows into and through liquid heating passage 206 is heated as it flows through the liquid heating passage 206.

FIG. 22 is similar to FIG. 18 using the heat exchange block of the invention, but converted to hold a bag-in-box liquid container 30 on top of the cooler body 12, and wherein the water bottle opening cap engaging pin 24 is used with the bag-in-box liquid container similarly to the showing in FIG. 19. The supply of water to the reservoir is as described for FIGS. 19 and 22, while operation of the heat exchange block is as described for FIGS. 15-18.

While specific air vent controls and a specific water flow control have been shown and described, various other air vent controls and water flow controls can be used either alone or in combination to control the water flow into the reservoir and/or the air flow into and out of the reservoir.

While the description describes the bag-in-box container as containing water and is directed to the use of water and water dispensers, any liquid to be dispensed, where appropriate, can be used in place of water.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. An adapter for allowing a bag-in-box liquid container having a collapsible bag containing the liquid within the box and a bag dispensing fitting extending from the bag for dispensing liquid from the bag, to be used with a conventional water cooler designed to use a substantially rigid water bottle having a water bottle opening with a water bottle opening cap as the source of water and having a water cooler body with a reservoir therein adapted to receive the substantially rigid water bottle positioned in inverted orientation at the top of the water cooler body with the water bottle opening extending into the water cooler body above the reservoir and having a water bottle opening cap engaging pin adapted to extend through the water bottle opening cap into the water bottle opening wherein water from the substantially rigid water bottle flows by gravity through the water bottle opening cap engaging pin through the water bottle opening from the substantially rigid water bottle into the reservoir and when water from the substantially rigid water bottle reaches a desired level in the reservoir, the water closes the bottle opening to the flow of air into the bottle thereby stopping flow of water from the substantially rigid water bottle into the reservoir, and including a user operated reservoir outlet to dispense water from the reservoir when desired by a user, comprising:

a holder for removably holding a bag-in-box liquid container in place of the water bottle at the top of the water cooler body; and a liquid supply line having opposite ends, one end adapted for removable attachment to the bag dispensing fitting when a bag-in-box liquid container is positioned in the holder and the opposite end adapted to connect with the water bottle opening cap engaging pin whereby water from the bag-in-box liquid container can flow by gravity from the bag-in-box liquid container through the bag dispensing fitting, the liquid supply line, and the water bottle opening cap engaging pin into the reservoir.

2. An adapter for allowing a bag-in-box liquid container to be used with a conventional water cooler according to claim 1, wherein the water bottle opening cap engaging pin includes openings therein positioned to receive liquid to flow through the water bottle opening cap engaging pin to the reservoir, and wherein the end of the liquid supply line adapted to connect with the water bottle opening cap engaging pin connects in liquid flow communication with the openings.

3. An adapter for allowing a bag-in-box liquid container to be used with a conventional water cooler according to claim 2, wherein the end of the liquid supply line adapted to connect with the water bottle opening cap engaging pin includes an adapter fitting configured to fit over an end of the water bottle opening cap engaging pin and form a liquid chamber around the openings wherein water will flow from the liquid supply line into the liquid chamber and into the openings.

4. An adapter for allowing a bag-in-box liquid container to be used with a conventional water cooler according to claim 3, wherein the liquid chamber is sealed around the water bottle opening cap engaging pin.

5. An adapter for allowing a bag-in-box liquid container to be used with a conventional water cooler according to claim 4, wherein the adapter fitting removably fits over the end of the water bottle opening cap engaging pin.

6. An adapter for allowing a bag-in-box liquid container to be used with a conventional water cooler according to claim 2, wherein the end of the liquid supply line adapted to connect with the water bottle opening cap engaging pin removably connects in liquid flow communication with the openings.

7. An adapter for allowing a bag-in-box liquid container to be used with a conventional water cooler according to claim 1, wherein the end of the liquid supply line adapted to connect with the water bottle opening cap engaging pin is adapted to removably connect with the water bottle opening cap engaging pin.

8. An adapter for allowing a bag-in-box liquid container to be used with a conventional water cooler according to claim 1, additionally including means for controlling flow of liquid into the reservoir to control the level of liquid in the reservoir.

9. An adapter for allowing a bag-in-box water container to be used with a conventional water cooler according to claim 8, wherein the reservoir is sealed and includes a vent from the reservoir to the atmosphere, wherein the means for controlling flow of liquid from the supply line into the reservoir to control the level of water in the reservoir includes a vent valve in the vent from the reservoir to the atmosphere responsive to the level of the liquid in the reservoir to allow flow of air through the vent into the reservoir when the level of the liquid in the reservoir is below a desired level and to stop flow of air from the reservoir when the level of liquid in the reservoir is at the desired level.

10. An adapter for allowing a bag-in-box water container to be used with a conventional water cooler according to claim 9, wherein the vent has an entrance in the reservoir, wherein the entrance is positioned in the reservoir at the desired level of liquid in the reservoir, and wherein the vent valve is a hydrophobic membrane that allows air to pass therethrough and does not allow liquid to pass therethrough whereby when the liquid is below the entrance, air can flow through the membrane and vent and when the liquid is in contact with the membrane, air cannot flow through the membrane and vent.

11. An adapter for allowing a bag-in-box water container to be used with a conventional water cooler according to claim 9, wherein the vent valve is a float valve in the vent responsive to the level of liquid in the reservoir whereby when the liquid in the reservoir is below the desired level, the float is below a float seat to allow flow of air through the vent and when the level of the liquid is at the desired level, the float is against the float seat to prevent flow of air through the vent.

12. An adapter for allowing a bag-in-box water container to be used with a conventional water cooler according to claim 8, wherein the means for controlling flow of liquid from the supply line into the reservoir to control the level of water in the reservoir includes a flow valve responsive to the level of the liquid in the reservoir at a location where the water flows into the reservoir to allow flow of liquid from the supply line into the reservoir when the level of the liquid in the reservoir is below a desired level and to stop flow of liquid from the supply line into the reservoir when the level of liquid in the reservoir is at the desired level.

13. A method of converting a conventional water cooler designed to use as a source of water a substantially rigid water bottle having a water bottle opening with a water bottle opening cap as the source of water and having a water cooler body with a reservoir therein adapted to receive the substantially rigid water bottle positioned in inverted orientation at the top of the water cooler body with the water bottle opening extending into the water cooler body above the reservoir and having a water bottle opening cap engaging pin adapted to extend through the water bottle opening cap into the water bottle opening wherein water from the substantially rigid water bottle flows by gravity through the water bottle opening cap engaging pin through the water bottle opening from the substantially rigid water bottle into the reservoir and when water from the substantially rigid water bottle reaches a desired level in the reservoir, the water closes the bottle opening to the flow of air into the bottle thereby stopping flow of water from the substantially rigid water bottle into the reservoir, to a water cooler adapted to use as a source of water a bag-in-box liquid container having a collapsible bag containing the liquid within the box and a bag dispensing fitting extending from the bag for dispensing liquid from the bag, comprising:

adding a holder for removably holding a bag-in-box liquid container in place of the water bottle at the top of the water cooler body; and connecting one end of a liquid supply line having opposite ends to the water bottle opening cap engaging pin, the opposite end adapted for removable attachment to the bag dispensing fitting when a bag-in-box liquid container is positioned in the holder whereby when the opposite end is attached to a bag dispensing fitting of a bag-in-box liquid container positioned in the holder, water from the bag-in-box liquid container can flow by gravity from the bag-in-box liquid container through the bag dispensing fitting, the liquid supply line, and the water bottle opening cap engaging pin into the reservoir.

14. A method of converting a conventional water cooler designed to use a substantially rigid water bottle as the source of water to a water cooler using a bag-in-box liquid container as the source of water according to claim 13, additionally including positioning a bag-in-box liquid container having a liquid contained in the bag therein in the holder and attaching the end of the liquid supply line adapted for removable attachment to the bag dispensing fitting to the bag dispensing fitting of the bag-in-box liquid container positioned in the holder.

15. A method of converting a conventional water cooler designed to use a substantially rigid water bottle as the source of water to a water cooler using a bag-in-box liquid container as the source of water according to claim 14, additionally including providing means for controlling flow of liquid from the bag-in-box liquid container into the reservoir to control the level of liquid in the reservoir.

16. A method of converting a conventional water cooler designed to use a substantially rigid water bottle as the source of water to a water cooler using a bag-in-box liquid container as the source of water according to claim 13, additionally including providing means for controlling flow of liquid from the bag-in-box liquid container into the reservoir to control the level of liquid in the reservoir.

* * * * *